US009016378B2

(12) United States Patent
Zhang et al.

(10) Patent No.: US 9,016,378 B2
(45) Date of Patent: Apr. 28, 2015

(54) SHALE GAS OPERATION METHOD

(75) Inventors: Mi Zhang, Sichuan (CN); Jun Chen, Sichuan (CN); Mingshe Wang, Sichuan (CN); Xuanguo Liu, Sichuan (CN); Ping Tang, Sichuan (CN); Meng He, Sichuan (CN); Jiangyang Wang, Sichuan (CN); Tao Chen, Sichuan (CN); Wei Xie, Sichuan (CN); Zhongcai Liang, Sichuan (CN); Yinchun Liu, Sichuan (CN); Guang Chen, Sichuan (CN)

(73) Assignee: Sichuan Honghua Petroleum Equipment Co. Ltd., Guanghan (CN)

( * ) Notice: Subject to any disclaimer, the term of this patent is extended or adjusted under 35 U.S.C. 154(b) by 157 days.

(21) Appl. No.: 13/460,010

(22) Filed: Apr. 30, 2012

(65) Prior Publication Data

US 2013/0206411 A1 Aug. 15, 2013

(30) Foreign Application Priority Data

Feb. 15, 2012 (CN) ..... PCT/CN2012/071169

(51) Int. Cl.

| | |
|---|---|
| ***E21B 43/26*** | (2006.01) |
| ***E21B 4/04*** | (2006.01) |
| ***B65D 6/18*** | (2006.01) |
| ***B65D 88/00*** | (2006.01) |
| ***B65D 88/32*** | (2006.01) |
| ***B65D 90/20*** | (2006.01) |
| ***E21B 43/00*** | (2006.01) |

(52) U.S. Cl.

CPC ..... *B65D 88/005* (2013.01); *B65D 88/32* (2013.01); *B65D 90/205* (2013.01); *E21B 43/00* (2013.01); *E21B 43/26* (2013.01)

USPC ..... 166/308.1; 166/50; 166/65.1; 166/245; 175/57; 175/62; 220/6; 220/9.2

(58) Field of Classification Search

USPC ..... 166/298, 265, 308.1–308.6, 50, 245; 175/57, 62, 77, 78; 220/6, 4.28, 720, 220/9.2, 9.3

See application file for complete search history.

(56) References Cited

U.S. PATENT DOCUMENTS 2,507,939 A * 5/1950 Smith ..... 220/666
2,916,058 A * 12/1959 Unthank ..... 141/48
2,931,409 A * 4/1960 Unthank ..... 220/666

(Continued)

FOREIGN PATENT DOCUMENTS

CN 1875168 A 12/2006
CN 101864937 A 10/2010

(Continued)

OTHER PUBLICATIONS

Schlumberger Oilfield Glossary entry for "spacing unit", accessed Jan. 16, 2014 via www.glossary.oilfield.slb.com.*

(Continued)

*Primary Examiner* — Blake Michener
(74) *Attorney, Agent, or Firm* — Mei & Mark LLP

(57) ABSTRACT

A method for performing shale gas operation is disclosed. The method may include drilling a first well, performing a fracturing operation in the well, recovering shale gas from the first well, supplying at least part of the shale gas recovered from the well to an electrical generator, generating electricity using the generator, and transferring the generated electricity to drilling equipment used to drill a second well.

20 Claims, 36 Drawing Sheets

(56) References Cited

U.S. PATENT DOCUMENTS

| | | | | |
|---|---|---|---|---|
| 4,036,361 | A * | 7/1977 | Jacobson et al. | 206/597 |
| 5,437,384 | A * | 8/1995 | Farrell | 220/1.5 |
| 5,554,453 | A * | 9/1996 | Steinfeld et al. | 429/415 |
| 5,622,277 | A * | 4/1997 | Van Giezen et al. | 220/6 |
| 5,746,343 | A * | 5/1998 | Waltke et al. | 220/9.4 |
| 5,897,012 | A * | 4/1999 | Sortwell | 220/4.28 |
| 7,823,644 | B2 * | 11/2010 | Maguire | 166/308.2 |
| 8,100,264 | B2 * | 1/2012 | Wood et al. | 206/600 |
| 2003/0111223 | A1 * | 6/2003 | Rouffignac et al. | 166/256 |
| 2003/0136558 | A1 * | 7/2003 | Wellington et al. | 166/245 |
| 2004/0108110 | A1 * | 6/2004 | Zupanick | 166/245 |
| 2004/0206504 | A1 * | 10/2004 | Rosato | 166/298 |
| 2005/0252656 | A1 * | 11/2005 | Maguire | 166/256 |
| 2007/0023186 | A1 * | 2/2007 | Kaminsky et al. | 166/266 |
| 2007/0089879 | A1 * | 4/2007 | Maguire | 166/259 |
| 2007/0181301 | A1 * | 8/2007 | O'Brien | 166/247 |
| 2008/0190606 | A1 * | 8/2008 | Maguire | 166/266 |
| 2009/0038795 | A1 | 2/2009 | Kaminsky et al. | |
| 2009/0151938 | A1 | 6/2009 | Conkle et al. | |
| 2011/0284214 | A1 | 11/2011 | Ayoub et al. | |
| 2012/0085541 | A1 * | 4/2012 | Love et al. | 166/308.1 |
| 2012/0255734 | A1 * | 10/2012 | Coli et al. | 166/305.1 |

FOREIGN PATENT DOCUMENTS

| | | | |
|---|---|---|---|
| CN | 102287175 | A | 12/2011 |
| WO | 2011000089 | A1 | 1/2011 |

OTHER PUBLICATIONS

Zhong, Zhiyong, et al., "Analysis on Development Prospect and Countermeasures of the Shale Gas Industry in Jiangxi Province," Energy Research and Management. Dec. 2011, No. 4, pp. 4-8, ISSN 1005-7676.

Guo, Kuichang, "Influence of the Shale Gas in United States on World Natural Gas Market," Power & Energy. Dec. 2011, vol. 32, No. 6, pp. 445-448, ISSN 2095-1256.

Li, Hongsheng, et al., "The Key Technologies for Exploration and Development of Shale Gas in the U.S.," China Petroleum Machinery. Sep. 2011, vol. 39, No. 9, pp. 73-83, ISSN 1001-4578.

Shi, Jin, "Development Status and Analysis on the Exploration Technology of Shale Gas," Proceedings of 2011 Coalbed Methane Symposium. Dec. 2011, pp. 462-469.

* cited by examiner

22

31

SHALE GAS OPERATION METHOD

PRIORITY

This application claims the priority of International Application No. PCT/CN2012/071169 filed on Feb. 15, 2012, the entire content of the above-mentioned application is incorporated herein by reference.

FIELD OF THE INVENTION

The present disclosure is directed to a method for gas exploitation operation, and more particularly, to a method for shale gas operation.

BACKGROUND

Shale gas refers to the natural gas accumulated in the dark mud shale or high-carbon mud shale and existing mainly in an absorbed or free form. Shale gas has the same physical and chemical properties as the conventional natural gas except that it adheres to and exists in the mud shale with extremely low permeability and porosity. The development depth range of shale gas is more than that of the coalbed gas, while its porosity, permeability and saturation are less than those of the coalbed gas. It thus becomes increasingly difficult to exploit shale gas to a great extent, and it is considered as non-conventional oil-gas resource by the industry.

As shale gas usually deposits in the compact rock stratum, it is considered to have high exploitation difficulty, low input-output ratio and high cost.

As shown in Neijiang Science Technology, Period 12, page 131, Table 3 (2010), for the shale gas exploitation in general, production enhancement measures and special well drilling methods need to be adopted because the shale gas is found in the shale fractures, micro-holes and stratum and such reservoir stratum typically has much lower permeability and higher gas flow resistance when compared with traditional natural gas formations.

As disclosed in Natural Gas Earth Science, Period 3, Volume 22, pages 511-516 (June, 2011), the main difference between shale gas exploitation and traditional natural gas exploitation is that in the shale gas exploitation process, horizontal well drilling and hydraulic fracturing methods are used in general. That is to say, on the basis of the provision of straight well, a horizontal well is provided as an auxiliary means to improve the collection rate. Furthermore, by combination with fracturing treatments, the permeability of the reservoir stratum can be further improved so that the gas in the stratum can flow into the well more easily.

However, the conventional shale gas operation method has the following disadvantages.

1. The operation cost is high. This is because in the multiple steps such as well drilling and fracturing, a diesel generator or an external power supply is needed as the power source for the equipment such as electric drilling machines and fracturing vehicles.

2. In general, a rigid round tank is used for storing water or for recovering liquids discharged from the well during the fracturing operation. During a fracturing operation, tens of rigid round tanks are needed for storing thousands of liters of water. Moreover, because of the large volume of the rigid tanks, they are not convenient to handle and require a large area for the well site. Also, the costs for transportation, leveling the well site, and the environmental recovery are high.

The shale gas operation method of the present disclosure addresses one or more of the problems set forth above.

SUMMARY

In one embodiment, the present disclosure is directed to a method for performing shale gas operation, including drilling a first well, performing a fracturing operation in the well, recovering shale gas from the first well, supplying at least part of the shale gas recovered from the well to an electrical generator, generating electricity using the generator, and transferring the generated electricity to drilling equipment used to drill a next well.

In another embodiment, the drilling equipment may be also provided with an external power supply.

In another embodiment, the equipment used for shale gas operation includes the first drilling machine and the second drilling machine.

In another embodiment, the shale gas operation method may comprise drilling a first substantially straight well section with the first drilling machine at a first location, moving the first drilling machine to a second location, drilling a second substantially straight well section with the first drilling machine at the second location.

The shale gas operation method may further comprise drilling a first substantially horizontal well section from the substantially straight well section at the first location using the second drilling machine, moving the second drilling machine to the second location, and drilling a second substantially horizontal well section from the substantially straight well section at the second location using the second drilling machine.

In a further embodiment, the shale gas operation method may further comprise providing the generated electricity to a fracturing vehicle. The fracturing vehicle may comprise hydraulic sand blast perforation equipment. The fracturing operation may comprise connecting a hydraulic sand blast perforation tool to the hydraulic sand blast perforation equipment, placing the tool at a predetermined position in the first well, performing segmental hydraulic sand blast perforation in the first well at an interval of 100 m to 150 m, performing annulus sand fracturing in the first well. The segmental hydraulic sand blast perforation at intervals of 100 m to 150 m and the annulus sand fracturing may be repeated.

In a further embodiment, after the segmental hydraulic sand blast perforation and before the annulus sand fracturing, injecting anti-penetrating fluid may be performed to increase the viscosity of the segment of sand column, avoiding any impact on the sand fracturing of the next segment.

In a further embodiment, sand flushing and well cleaning may be performed to remove the sand grains from the well to the surface.

In another embodiment, recovering shale gas from a well may be performed as follows: gas-liquid separation may be performed by one of spray replacement and gas lift to lead the gas out of the well and to separate shale gas and liquid. The liquid may be transferred to a container for treatment. At least part of the shale gas may be transferred to the electrical generator.

When a plurality of wells meet the shale gas recovery conditions, to save the cost, all or part of the shale gas recovered from the plurality of wells positions can be led to a same gas-liquid separation location for centralized treatment, reducing the environmental pollution on the construction site.

In another embodiment, in the above described shale gas operation method, the fracturing operation comprises storing a liquid used for the fracturing operation in a liquid container.

The liquid container may include a foldable support structure and a capsule connected to the foldable support structure and configurable for storing a liquid. The foldable support structure may comprise at least two frames and a foldable supporting mechanism disposed between the two frames and connecting the two frames.

When the shale gas operation is carried out with the above described liquid container, it may result in a high mobility. When transportation is needed, the capsule and the foldable support structure can be folded respectively, thereby reducing the space occupied by the liquid container and facilitating handling and transportation.

In another embodiment, the liquid container may include a locking mechanism configured to limit a position of the foldable supporting mechanism relative to the at least two frames.

In another embodiment, the said liquid container also may include a position locking bar and a pulling link connected with the position locking bar.

In another embodiment, the liquid container may include a net disposed between the soft capsule and the foldable support structure. The net may be soft, flexible, or may be rigid. The net may help maintain (e.g., by restraining) the soft capsule within the space defined by the support structure, thereby preventing the soft capsule from squeezing out of the space from open gaps between any pair of adjacent frames when the soft capsule is filled with liquid. Accordingly, the life of the soft capsule and the reliability of the device may be increased. In addition, as the shape of the flexible net matches with that of the inner wall of the said support structure, the force of the soft capsule acting on the support structure can be reduced, thereby reducing the deformation of the bracket and improving the service life and safety. The liquid container may further include an elastic member disposed in the net, wherein the elastic member compresses the net inside the foldable support structure. The elastic member may be an elastic ribbon.

In the above described shale gas operation method, the fracturing operation comprises storing a liquid used for the fracturing operation in a liquid container. The liquid container may comprise a foldable support structure including a plurality of receiving containers, a base support disposed at a bottom portion of the plurality of frames; and a plurality of capsules. Each capsule may be at least partially disposed within one of the plurality of receiving containers, and may be configured for storing a liquid. The receiving containers may be rigid containers.

In a further embodiment, each of the plurality of receiving containers has a bottom portion of a cone shape. Such a structure allows the liquid container to be suitable for the fluid substance, e.g. for containing sand.

In a further embodiment, the support structure may include at least one locking component associated with at least one of the first sliding sleeve or the second sliding sleeve and operable to block (limit/prevent) or allow movement of at least one of the first sliding sleeve or the second sliding sleeve along the first frame member or the second frame member, thereby locking or unlocking the positions of at least one of the first sliding sleeve or the second sliding sleeve relative to the first frame member or the second frame member.

In another embodiment, the liquid container also includes a ring structure configured to secure a top portion of each of the plurality of soft capsules to the frame of the foldable support structure. This ring structure allows the soft capsule to be compression-jointed stably on the frame, preventing the soft capsule from detaching from the frame when storing water.

In another embodiment, the liquid container may include an assembly of separate liquid containers. The liquid container assembly may include at least two liquid containers and a connecting member used for securing at least two liquid containers together. One end of the connecting member is secured to one of the at least two liquid containers, and the other end is secured to another of the at least two liquid containers.

In a further embodiment, the connecting member may be placed across two adjacent frame members of the two liquid containers arranged side by side. At least one screw may secure the one or more connectors to the two adjacent frame sides of the two liquid containers, thereby holding the two liquid containers together to form the liquid container assembly.

In view of the above mentioned features, the method for performing the shale gas operation of the present disclosure has the following beneficial effects:

1. During the shale gas operation, before the shale gas well meets the production conditions, electricity can be provided to the electronic operation equipment through a diesel generator or an external power supply to accomplish the operations such as well drilling and fracturing. When the shale gas production conditions are met, the shale gas recovered from the well may be used to generate on-site electricity. The shale gas may be converted into electrical power through the electrical generator to supply electricity to the electrically-operated equipment. Thus, the exploitation of gas by combining gas with electrical power can be achieved. The production operation may proceed continuously. Furthermore, the on-site electricity generation can be a temporary and mobile arrangement. The on-site electricity generation installation can be moved to the next area when a certain area is done with drilling. One electricity generation set can be installed for each drilling area, or can be installed at a central location such that it can supply electricity to several drilling areas.

2. Because the soft capsule and the supporting structure can be folded, the space occupied by the liquid container is reduced, thereby facilitating handling and transportation.

3. Segmental fracturing process through a coiled tubing drilling system has the beneficial effects of simple structure, great operation depth and good fracturing effect.

4. The waste water, after being separated and collected, can be treated centralized, thereby reducing the environmental pollution on the construction site.

Features and advantages consistent with the disclosure will be set forth in part in the description which follows, and in part will be apparent from the description, or may be learned by practice of the disclosure. Such features and advantages will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DETAILED DESCRIPTION

Reference will now be made in detail to the drawings. Wherever possible, the same reference numbers will be used throughout the drawings to refer to the same or like parts.

Figure 1A:
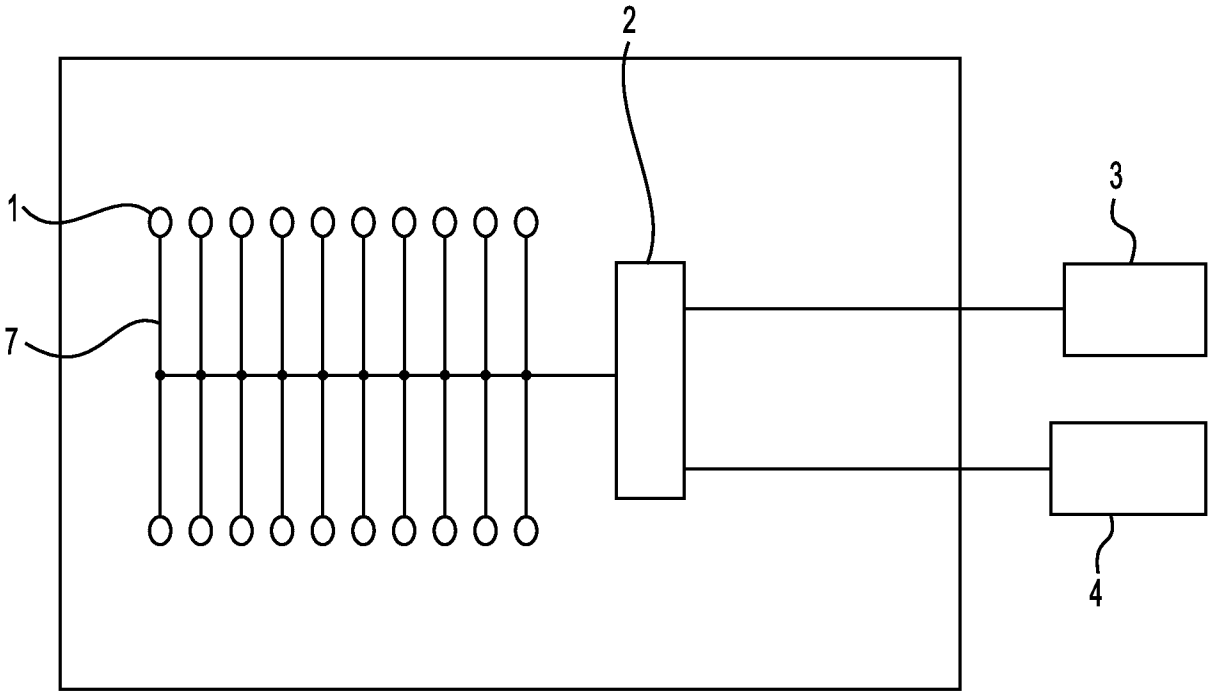
FIG. 1A illustrates a diagram of a well site for the shale gas operation method according to some embodiments of the present disclosure.
Figure 1B:
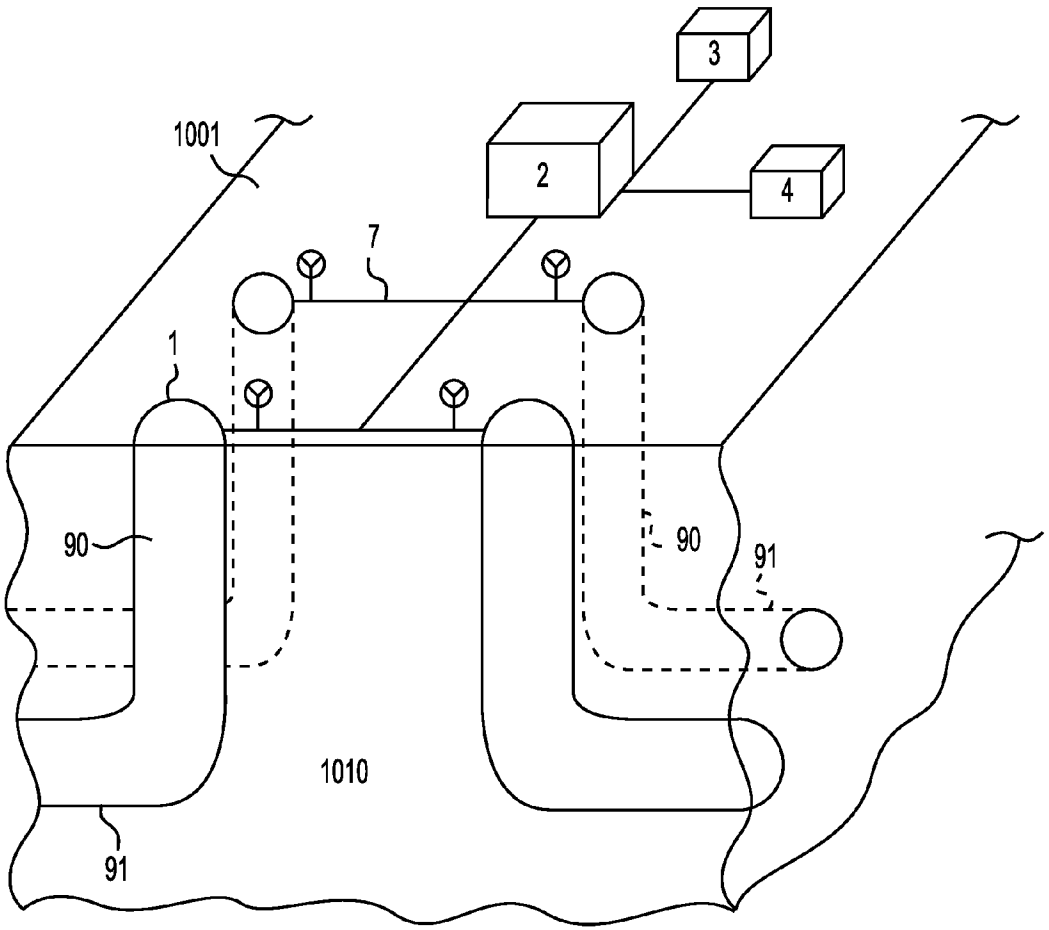
FIG. 1B is a schematic cross-section view of a portion of the well site of FIG. 1A.
Figure 2A:
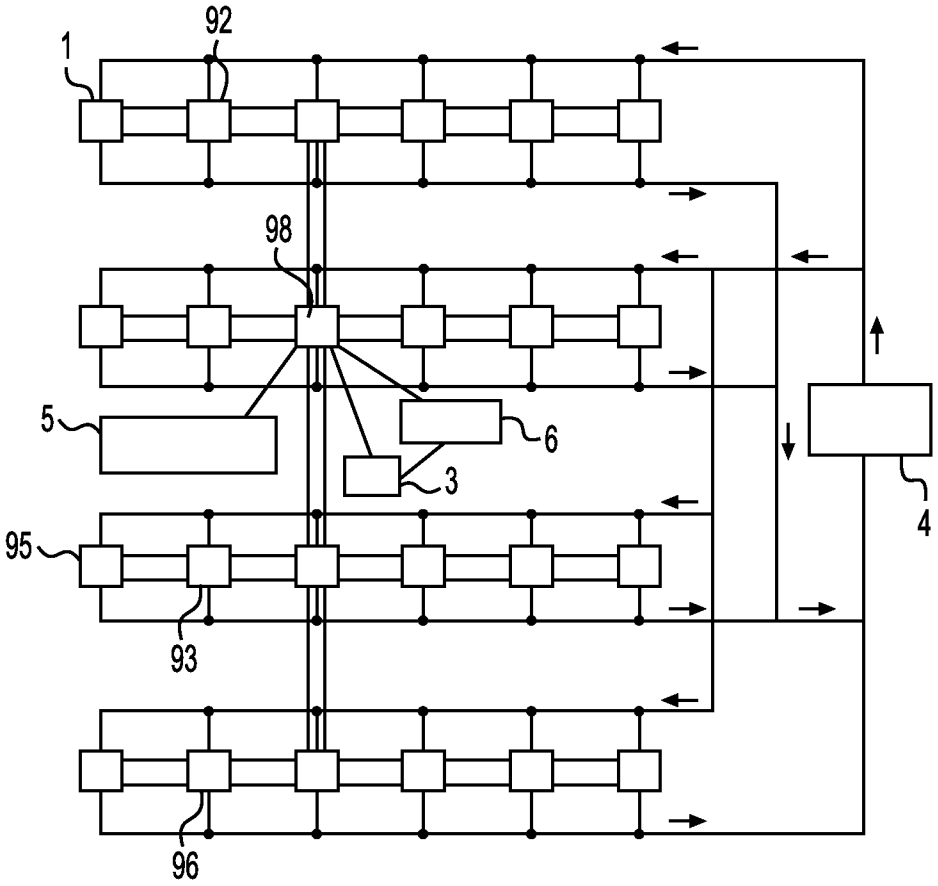
FIG. 2A illustrates a diagram of an equipment arrangement for the shale gas operation method according to some embodiments of the present disclosure.

Referring to FIGS. 1A, 1B, and 2A, in some embodiments including the first embodiment, the shale gas operation method may include the following steps:

<Drilling at Least One Shale Gas Well>

Initially, a substantially straight well may be drilled to form vertical well section 90. With a super single drilling machine or a rack-and-pinion drilling machine as a first drilling machine, the water-containing or complicated layer may be penetrated, the surface stratum casing may be lowered, and the well may be secured. After the straight well section is drilled, the super single drilling machine or rack-and-pinion drilling machine may be moved by 4 to 5 m to a next well location and the above straight well drilling may be performed at the next well location.

After the first substantially straight well operation is completed, a first substantially horizontal well section may be drilled from the substantially straight well section at the first location using a step drilling machine as a second drilling machine. This forms a horizontal well section 91. In some embodiments, after a casing of 30 m is drilled, directional drilling may be carried out with dynamic drilling tools having MWD measuring meters integrated to the drilling tool. The target zone may be located in the middle part of the shale gas layer. After the landing point is achieved, horizontal drilling may be carried out. The length of the horizontal section may be approximately 2 km. In some embodiments, the first drilling machine used for straight well drilling and the second drilling machine used for horizontal well drilling may be operated simultaneously at the well site. After the horizontal well drilling in the horizontal section is completed, the production stratum casing may be lowered and the well may be secured with low-density cement such as foam.

After the operation of the first horizontal well drilling is completed, a fracturing operation may be carried out immediately. Referring to FIG. 1, the second drilling machine in this step may be moved to the next vertical well section 90 to drill another substantially horizontal well section 91. The above operation may be continued until drilling the straight wells and the horizontal wells at the location 1 are completed.

The first drilling machine and the second drilling machine may need an external power supply during the operation. The electric equipment for well drilling, such as the first drilling machine and the second drilling machine, may be connected with diesel generator 5 or use an external power supply instead of diesel generator 5 as the electricity supply for the operation until the shale gas well becomes suitable for gas production.

<Fracturing Operation>

Figure 2B:
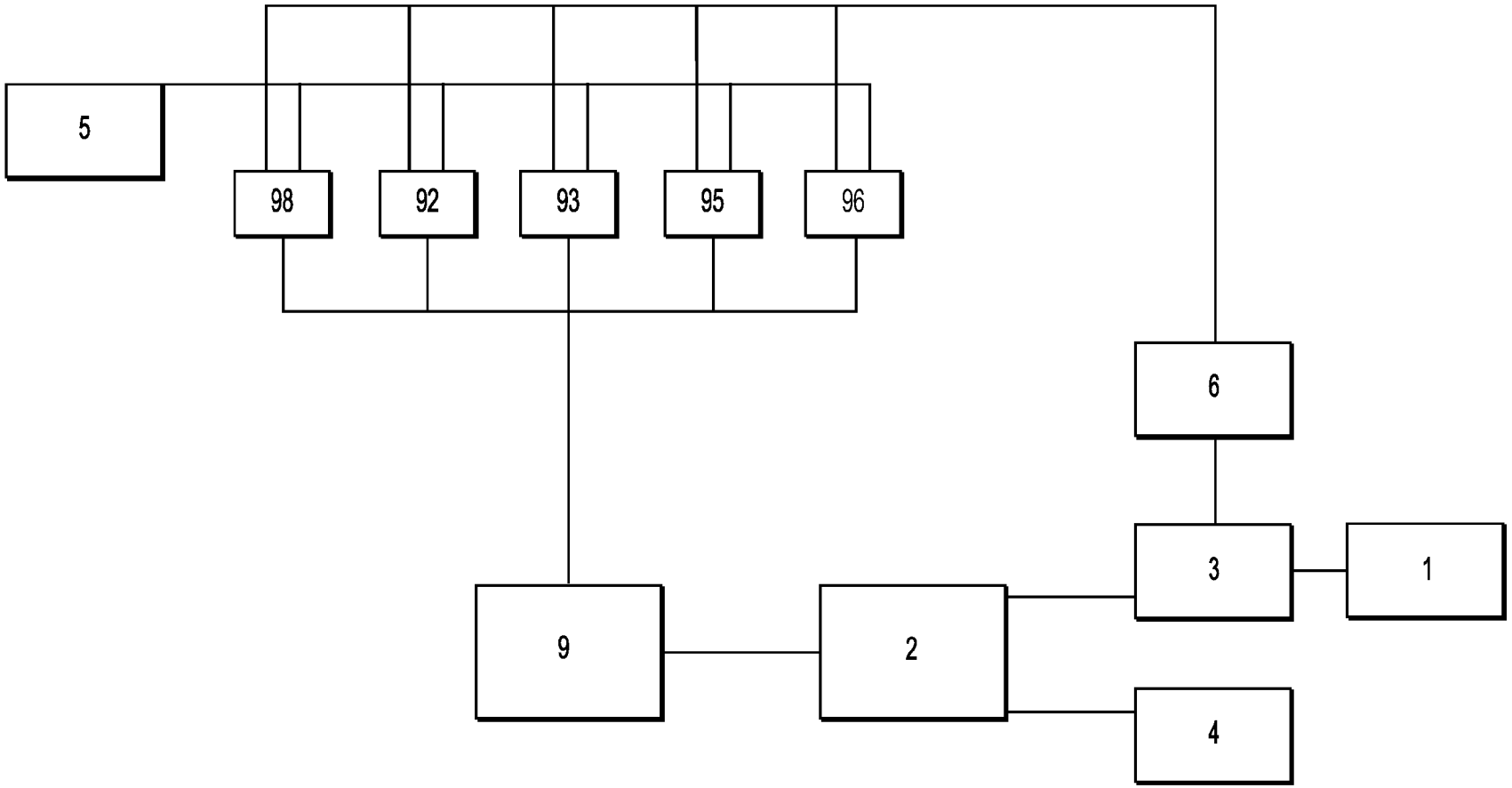
FIG. 2B is a schematic diagram of another equipment arrangement.
Figure 2C:
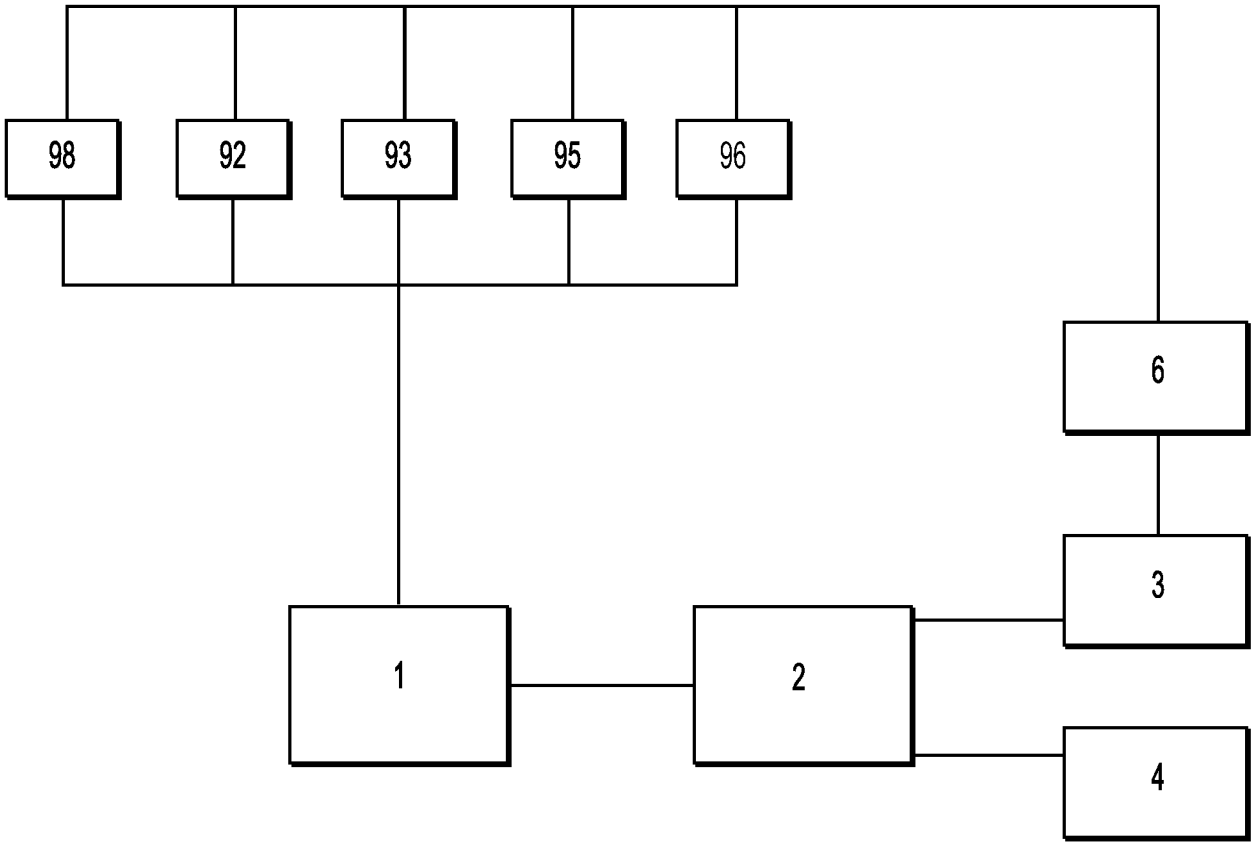
FIG. 2C is a schematic diagram of another equipment arrangement.
Figure 2D:
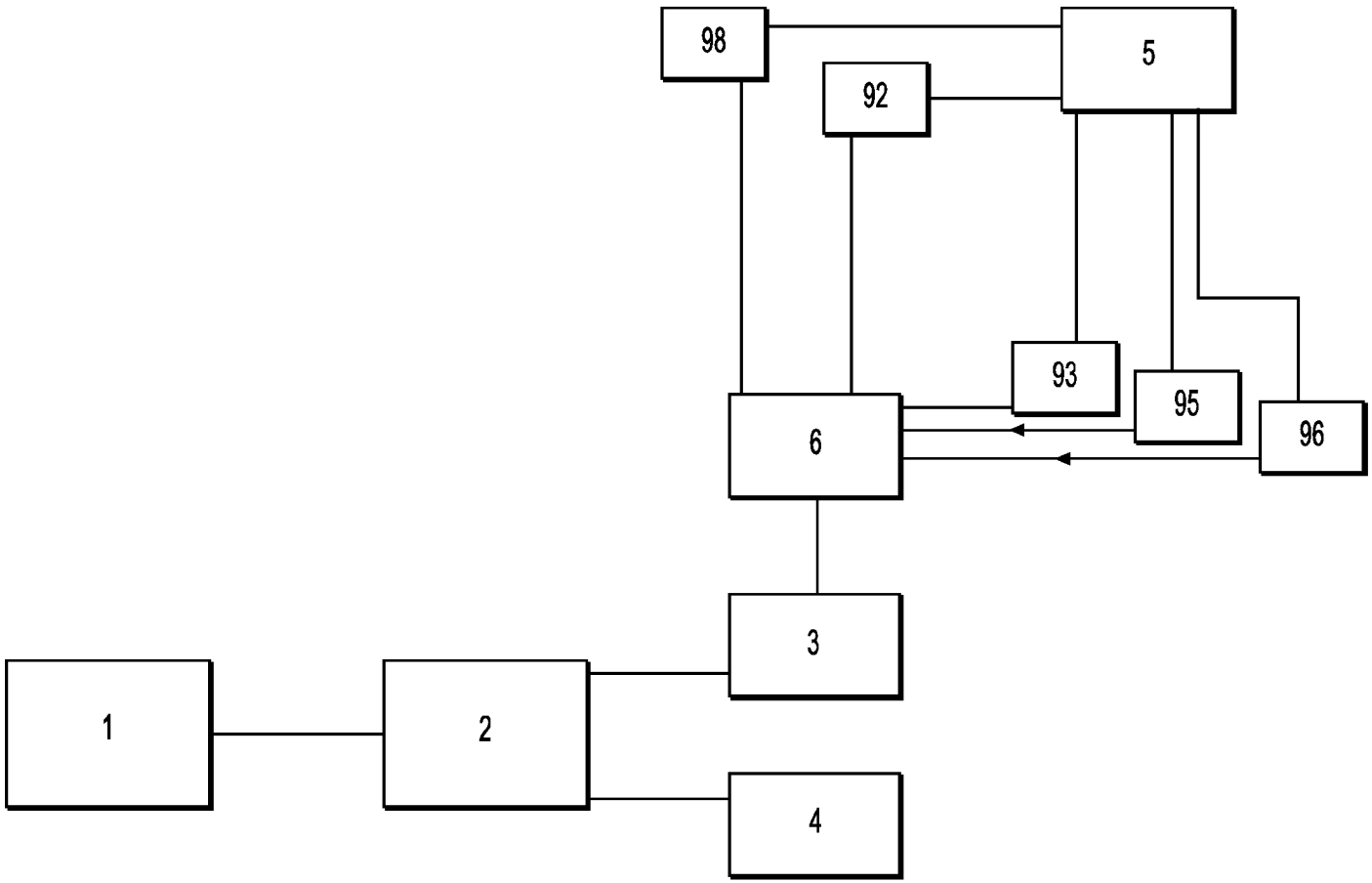
FIG. 2D is a schematic diagram of another equipment arrangement.
Figure 2E:
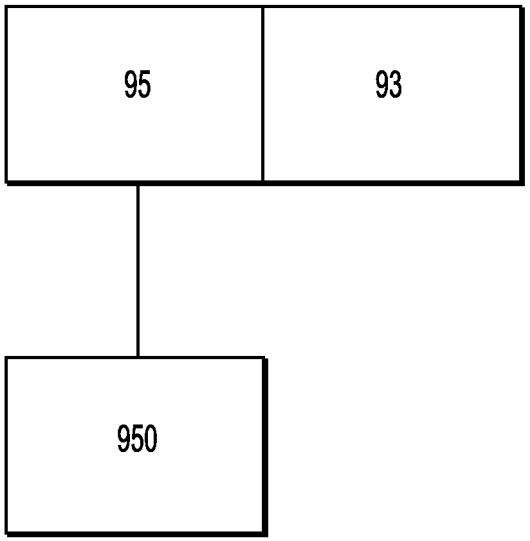
FIG. 2E is an exemplary schematic diagram of a fracturing vehicle.

Initially, fracturing equipment including a coiled tubing drilling system needed for fracturing operations, an injection head, a fracturing vehicle 93 and a liquid container 4 may be positioned and assembled. As shown in FIG. 2E, the hydraulic sand blast perforating equipment 95 can be mounted to the fracturing vehicle 93. A hydraulic sand blast perforation tool 950 can be mounted to the hydraulic sand blast perforating equipment 95 as the injection head. After the horizontal segment of the well is secured after Step a, a fracturing operation may be performed with continuous perforation by hydraulic sand blasting and hydraulic fracturing to the annulus using the fracturing equipment. Alternatively, the fracturing vehicle 93 may be distinct from the perforating equipment 95.

FIG. 1B is an alternative view of FIG. 1A and shows vertical well sections 90 and horizontal well sections 91. FIG. 1B also includes schematic representations of gas and liquid line 7, well location 1, separator 2, collection station 3, liquid tank 4, ground surface 1001, and underground 1010.

In FIG. 2A, a network of shale gas operation equipment is shown schematically. Liquid tank 4, such as liquid container assembly 900, supplies liquid to the well locations 1 for circulation, as shown by the arrows. First drill 98 may drill a vertical well section 90, while second drill 92 drills a horizontal well section. The perforating equipment 95 can work on another well location while the fracturing vehicle 93 works on another well location. The fracturing vehicle 93 may conduct spray replacement or displacement flowing to inject a proppant in to the annulus of the well or to inject hydraulic fluid mixed with sand to prevent the fractured space from closing. In an alternative, the fracturing vehicle 93 may include gas lifting equipment. Liquid from the liquid tank 4, such as from first liquid container 800 flushes the well sections, as by well cleaning equipment 96, which performs sand flushing and well washing. Waste liquid accumulates in another liquid container 800 of liquid tank 4. FIGS. 2B-2D schematically indicate alternative connections for the sets of electrical equipment.

FIG. 2B schematically shows a first set of electrical equipment, such as a diesel generator or external power supply 5. The first set of electrical equipment powers first drill 98, second drill 92, fracturing vehicle 93, perforation equipment 95, and well cleaning equipment 96. As a result of the work done by the first drill 98, second drill 92, fracturing vehicle 93, perforation equipment 95, and well cleaning equipment 96, shale gas and waste is generated out of well location 1. A separator 2 diverts the waste to liquid tank 4, while collection station 3 gathers shale gas. The shale gas is used to generate electricity in the second set of electrical equipment, which is an electric generator 6. The first set of electrical equipment is then deactivated and electricity is supplied to first drill 98, second drill 92, fracturing vehicle 93, perforation equipment 95, and well cleaning equipment 96 via the electric generator 6.

FIG. 2C shows an alternative having only a third set of electrical equipment in the form of an electric generator 6 that is powered by shale gas from collection station 3 of well location 1. The electric generator 6 supplies power to first drill 98, second drill 92, fracturing vehicle 93, perforation equipment 95, and well cleaning equipment 96. Thus, a first well location 1 provides shale gas to power a second well location 9.

In FIG. 2D, a well location 1, provides shale gas and liquid to separator 2, and liquid is diverted to liquid tank 4, while shale gas is diverted to collection station 3. The shale gas powers electric generator 6 to operate equipment (first drill 98, second drill 92, fracturing vehicle 93, perforation equipment 95, and well cleaning equipment 96) at another well location. An optional diesel generator 5 powers the equipment with, or as an alternative to, the electric generator 6.

Figure 3:
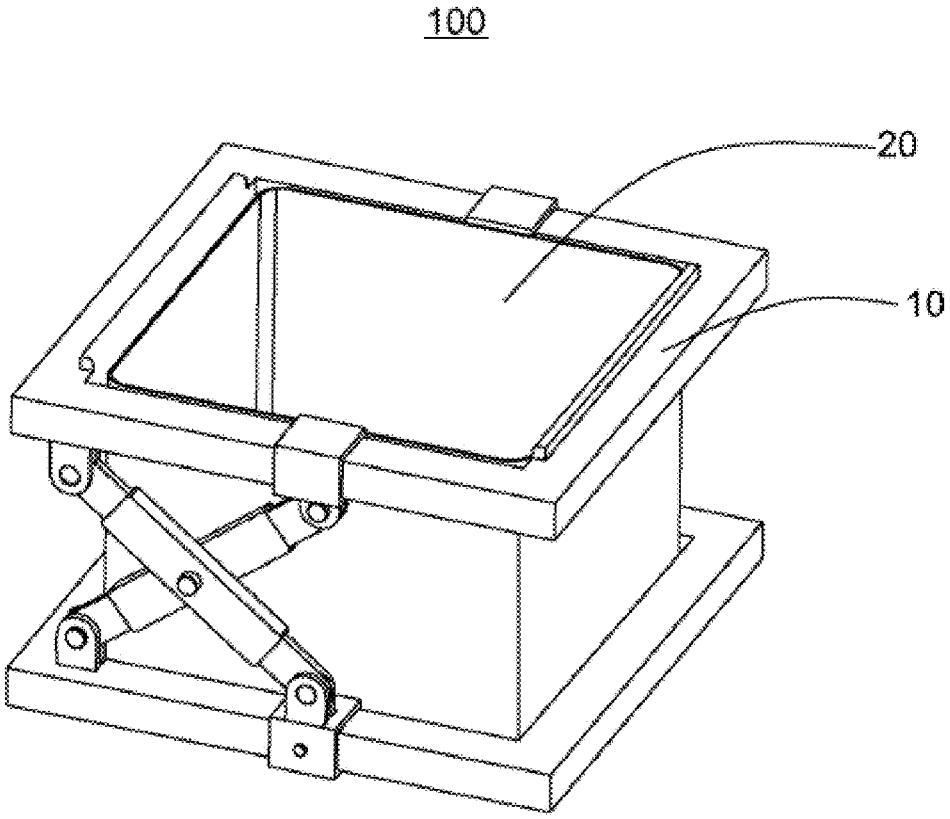
FIG. 3 illustrates a perspective view of a liquid container according to a first exemplary disclosed embodiment.

FIG. 3 illustrates a perspective view of a liquid container 100 according to a first exemplary disclosed embodiment. Throughout this discussion of various embodiments, the term "liquid container" may refer to a single liquid container or a liquid container assembly including more than one liquid container. The term "liquid" may refer to a liquid, a fluid, a gas, or a mixture of a liquid and a solid. The solid is, for example, sand, dirt, and/or rock. The liquid used for the fracturing operation may be stored in a liquid container 100. The liquid used for the fracturing operation may include fracturing liquid and water used for well cleaning after fracturing.

Figure 5:
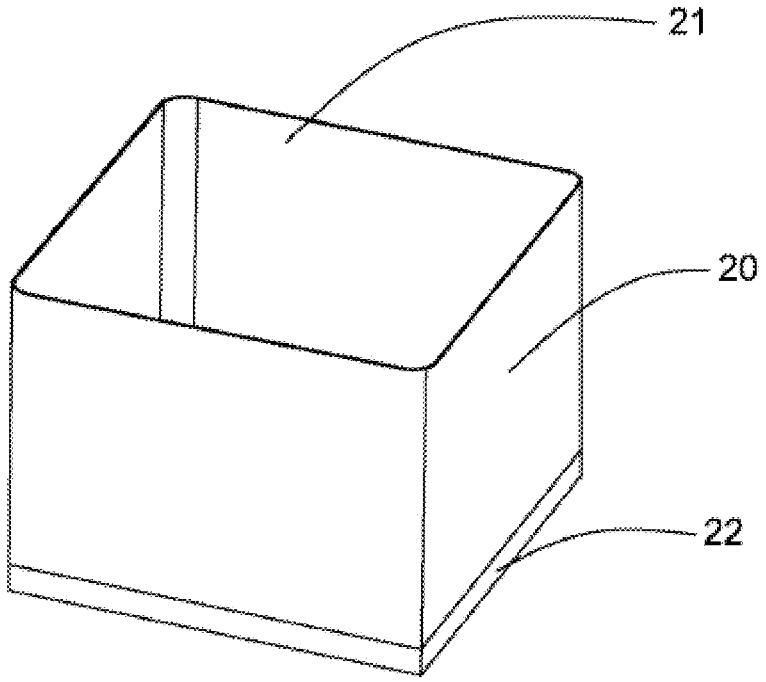
FIG. 5 illustrates a perspective view of a soft capsule in an expanded state according to an exemplary disclosed embodiment.

The liquid container 100 may include a support structure 10 and a soft, flexible capsule 20. The support structure 10 may be at least partially foldable. That is, at least a portion of the support structure 10 may be expanded to an open state or expanded position, e.g., as shown in FIG. 1, and that portion may be folded to a folded state or closed position, e.g., as shown in FIG. 5. The soft capsule 20 may be accommodated or disposed within a space defined by the support structure 10. The soft capsule 20 may be supported by the support structure 10 when disposed therein.

Figure 4:
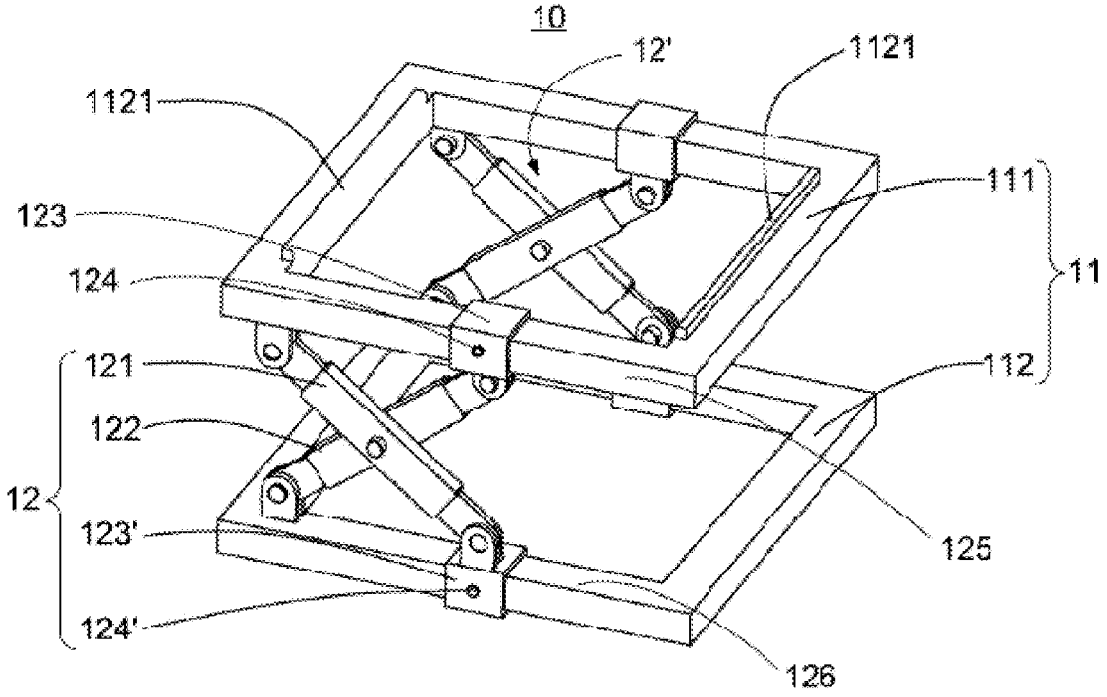
FIG. 4 illustrates a perspective view of a support structure of the liquid container of FIG. 3 according to a first exemplary disclosed embodiment.

FIG. 4 illustrates a perspective view of the support structure 10 of the liquid container 100 shown in FIG. 3, according to an exemplary disclosed embodiment. The support structure 10 may include a main body 11 and at least a first foldable supporting mechanism 12 and a second foldable supporting mechanism 12'. The first and the second foldable supporting mechanisms 12 and 12' may be substantially identical to one another, and may include similar components. The main body 11 may include a plurality of frames, for example, a first frame 111 and a second frame 112. The first frame 111 may be stacked above the second frame 112 with corresponding frame members facing each other. The first frame 111 may include one or more fixing blocks 1121 located at a top side that is opposite to the second frame 112, i.e., that does not face the second frame 112.

Referring to FIG. 4, the first frame 111 and the second frame 112 may have substantially the same shape or may have different shapes. For example, as shown in FIG. 4, the first frame 111 and the second frame 112 have a quadrilateral shape, such as, a rectangular or square shape. It is understood that the first frame 111 and the second frame 112 may have any suitable shape, such as, a triangle, a pentagon, a hexagon, any other polygon, a circle, or an irregular shape.

The first frame 111 and the second frame 112 may be connected by the foldable supporting mechanism 12 disposed therebetween. The first and the second foldable supporting mechanisms 12 and 12' may be disposed between the first and the second frames 111 and 112, on two opposite sides facing one another (e.g., on the front and rear sides as shown in FIG. 4). Each of the first and the second foldable supporting mechanisms 12 and 12' may connect corresponding frame members of the first and the second frames 111 and 112.

Referring to FIG. 4, the first foldable supporting mechanisms 12 may include a first linkage 121 and a second linkage 122 cross-connected with the first linkage 121 through a pivotal rod provided at substantially a middle section of the first linkage 121 and the second linkage 122. The first foldable supporting mechanism 12 also may include a first sliding sleeve 123 and a second sliding sleeve 123'. The first sliding sleeve 123 and the second sliding sleeve 123' may be slidably disposed on corresponding frame members of the first frame 111 and the second frame 112. For example, the first sliding sleeve 123 may be disposed on a first frame member 125 of the first frame 111, and the second sliding sleeve 123' may be disposed on a corresponding second frame member 126 of the second frame 112. The first and the second sliding sleeves 123 and 123' may be slidable along the corresponding first and second frame members 125 and 126 as the foldable support structure 10 is moved between the open and closed positions. The first linkage 121 may include an end pivotally connected with the first frame 111, and another end connected with the second sliding sleeve 123' disposed on the second frame 112. The second linkage 122 may include one end pivotally connected with the second frame 112, and another end connected with the first sliding sleeve 123 disposed on the first frame 111.

Referring to FIG. 4, the foldable support structure 10 may include at least one locking component associated with at least one of the first sliding sleeve 123 or the second sliding sleeve 123' and operable to block (limit/prevent) or allow movement of at least one of the first sliding sleeve 123 or the second sliding sleeve 123' along the first frame member 125 or the second frame member 126, thereby locking or unlocking the positions of at least one of the first sliding sleeve 123 or the second sliding sleeve 123' relative to the first frame member 125 or the second frame member 126. For example, the first foldable supporting mechanism 12 may include a first locking component 124. The first locking component 124 may be disposed on the first sliding sleeve 123, or may be a standing alone component separated from the first sliding sleeve 123. The first foldable supporting mechanism 12 may include a second locking component 124', which may be different from or similar to the first locking component 124. The second locking component 124' may be disposed on the second sliding sleeve 123', or may be a standing alone component separated from the second sliding sleeve 123'.

Referring to FIG. 4, when the first locking component 124 and the second locking component 124' are engaged, they may block (limit/prevent) the movement of the first sliding sleeves 123 and the second sliding sleeve 123' along the first frame member 125 of the first frame 111 and the second frame member 126 of the second frame 112, thereby locking or fixing the position of the first sliding sleeve 123 and the second sliding sleeve 123', and accordingly, locking or fixing the position of the first foldable supporting mechanism 12. As shown in FIG. 4, the support structure 10 is in an open, expanded, or unfolded position. When the first and the second locking components 124 and 124' are disengaged, the first sliding sleeves 123 and the second sliding sleeve 123' may be moved (e.g., slid) along the first frame member 125 of the first frame 111 and the second frame member 126 of the second frame 112, and as a result, the first foldable supporting mechanism 12 may be folded or closed. FIG. 4 shows the foldable support structure 10 in a folded state or closed position, in which the foldable supporting mechanisms 12 and 12' are folded or closed, and the first and second frames 111 and 112 are positioned substantially next to each other.

In some embodiments, the second foldable supporting mechanism 12' may include substantially the same structure as the first foldable supporting mechanism 12, and therefore, may include similar components as those included in the first foldable supporting mechanism 12. In some embodiments, it is possible for the second foldable supporting mechanism 12' to include components different from those of first foldable supporting mechanism 12.

FIG. 5 illustrates a perspective view of the soft capsule 20 in an expanded state according to an exemplary disclosed embodiment. The soft capsule 20 may be made of any suitable materials that render the soft capsule 20 flexible, and that enables the soft capsule 20 to be capable of being expanded and collapsed or folded. In one embodiment, the soft capsule 20 may be made of natural rubber or synthetic rubber. For example, the soft capsule 20 may be made of chlorosulfonated polyethylene or the like material. The soft capsule 20 may be utilized for storing a suitable liquid.

As shown in FIG. 5, the shape of the soft capsule 20 in an expanded state may substantially match the space defined by the support structure 10. In some embodiment, the shape of a top opening portion 21 of the soft capsule 20 may match the shape of first frame 111 and/or the second frame 112. For example, when the first and the second frames 111 and 112 have a rectangular shape, the top opening portion 21, in the expanded state, may have a rectangular shape.

As shown in FIG. 5, the soft capsule 20 may include a pad or plate 22 disposed at a bottom portion. The pad 22 may prevent or reduce wear at the bottom portion of the soft capsule 20. When the pad 22 is worn, the pad 22 may be conveniently replaced. In one embodiment, the pad 22 may be an integral single pad that may be fixed to the bottom portion of the soft capsule 20. In another embodiment, the pad 22 may be a separate part detachably attached to the bottom portion of the soft capsule 20. In some embodiments, the pad 22 may include a plurality of small pads. When one of the plurality of small pads is worn, instead of replacing the entire pad 22, the specific worn small pad may be replaced.

The soft capsule 20 may be disposed within the space defined by the support structure 10, as shown in FIG. 3. The top opening portion 21 shown in FIG. 5 may be secured to a portion of the support structure 10. For example, a circumferential portion of the top opening portion 21 may be secured to the one or more fixing blocks 1121 (shown in FIG. 4) provided on a top frame, e.g., the first frame 111, of the support structure 10, by a suitable means, such as, for example, clamp, glue, or screw and nut, to prevent break away from the support structure 10 when the soft capsule 20 is filled with liquid.

Figure 6:
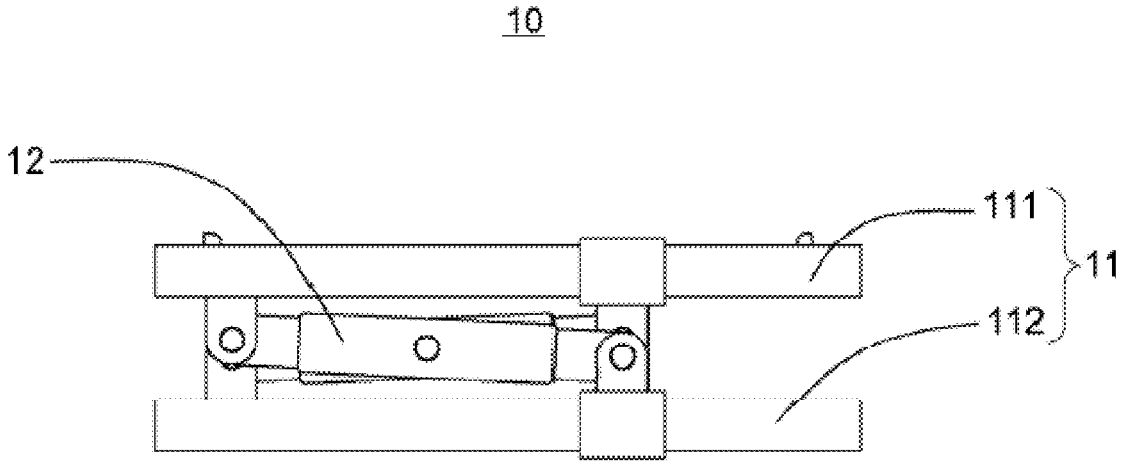
FIG. 6 illustrates a side view of the support structure of FIG. 4 in a folded state according to a first exemplary disclosed embodiment.

FIG. 6 illustrates a side view of the support structure 10 of FIG. 4 in a folded state or closed position according to an exemplary disclosed embodiment. When the liquid container 100 is used for storing liquid, the soft capsule 20 is disposed within the space defined by the support structure 10. When the liquid container 100 is not used for storing liquid, the soft capsule 20 may be taken out of the support structure 10. The soft capsule 20 may be collapsed or folded, because of its softness and flexibility. The first and the second locking components 124 and 124' may be disassembled or disengaged from the support structure 10, thereby allowing the first and the second sliding sleeves 123 and 123' to be moved along the corresponding first frame member 125 and second frame member 126, respectively. Thus, the foldable supporting mechanisms 12 and 12' may be folded, causing the support structure 10 to be folded, as shown in FIG. 6. The folded support structure 10 reduces its overall size and therefore the space it occupies, thereby facilitating storage and transportation. Accordingly, the cost associated with the storage and transportation of the liquid container 100 is reduced.

Still referring to FIG. 6, in some embodiments, when the liquid container 100 is not in use for storing liquid, the soft capsule 20 may not need to be taken out of the support structure 10 when the support structure 10 is folded. In such embodiments, the first and the second locking components 124 and 124' may be disassembled or disengaged from the support structure 10, thereby enabling the first and the second sliding sleeves 123 and 123' to be moved along corresponding first frame member 125 and the second frame member 126, respectively. The support structure 10 may then be placed in a folded state, so that the liquid container 100, including the soft capsule 20 and the support structure 10, is placed in the folded state or closed position. The folded liquid container 100 reduces the space it occupies, and facilitates storage and transportation, thereby reducing the cost associated with storage and transportation.

In the embodiments shown in FIGS. 3-6, the liquid container 100 includes two foldable supporting mechanisms 12 and 12'. It is understood that in other embodiments, the liquid container 100 may include any suitable number of foldable supporting mechanisms, such as, for example, one, three, four, etc.

During the annulus sand fracturing operation, in accordance with the stress direction of the stratum, a high pressure, for instance, 50 MPa or higher, may be applied to the rock stratum through the hydraulic fracturing fluid to cause the stratum to crack and generate a large number of fractures. Meanwhile, proppant may be injected in to the annulus to penetrate into the fractures, thereby establishing a passage for shale gas flow. The extension degree of the fracture may be controlled depending on the status of the stratum. The length of the fracture may be up to 100 m. The sand in the proppant may prevent the fractures from re-closing and re-blocking the gas flow after the pressure of the fracturing vehicle 93 is reduced. The stratum fractures may be connected in the form of nets or branches, which may increase shale gas output.

The annulus perforation is done via hydraulic sand blasting which may be carried out by injecting the water containing sand particles at a high pressure, e.g., 12 MPa, out of a spraying nozzle, such as perforation tool 950, at a speed of 190 m/s. To accelerate the perforation rate, fine sand may be added to the fluid. For instance, in about 15 minutes, the fluid may penetrate the casing and bore a hole in the rock stratum, which provides the suitable conditions for the next step of fracturing operation.

The electrical equipment for fracturing, such as a fracturing vehicle 93 and a coiled tubing drilling system, may be connected with diesel generator 5 or use an external power supply as the power supply for the operation until the shale gas well becomes suitable for gas production.

The fracturing equipment may include two parts, i.e. ground equipment and a fracturing vehicle 93. The ground equipment may include a well sealing device, a wellhead ball valve, a ball injector, a moveable elbow, a union, a wax ball manifold and a fracturing manifold, which are ground control tools above the wellhead. This equipment may be used to collect the liquid pumped out of the fracturing vehicle 93 and to inject it into the target layer of the fracturing well.

The fracturing vehicle 93 may be used to inject high-pressure large-displacement fracturing liquid into a well in order to fracture the stratum and to extrude the proppant into the fracture. The fracturing vehicle may need external power supply during the operation.

<Recovering Shale Gas from a Well>

A spray replacement or gas lifting method may be used at various well locations 1, 9 to recover the shale gas from the well. Initially, the well may be cleaned and a device such as well cleaning equipment 96, may be lowered into the well through a coiled tubing drilling system. The gas in the well may be pushed out using the spray replacement method or the gas lifting method. In the spray replacement method, a displacement fluid flows in to the well to replace the fracturing fluid, and in the gas lift method, a gas is injected, and both methods provide expulsion of shale gas. The shale gas may flow to the wellhead and converge in the gas pipe. Referring to FIGS. 1A and 2A, liquid may be separated from the shale gas through the separator 2. The shale gas enters a gas collection station 3, and the liquid enters a liquid tank 4. The liquid may flow from a number of well sites and converge in the liquid tank 4, and may further be treated in a treatment station.

In this step, the electrical equipment for recovering shale gas from the well may be connected to a diesel generator 5 or use an external power supply for gas lifting or spray replacement until the first shale gas well becomes suitable for gas production.

In this step, when the first well becomes suitable for gas production, shale gas can be recovered from the first well and gas-liquid separation can be carried out with the gas-liquid separation device. When there are a certain number of well locations that become suitable for the gas recovery conditions, to save the cost associated with the operation, all or part of the shale gas may be recovered from the various well locations 1 can be supplied to the same gas-liquid separation station for centralized treatment.

<Supplying at Least Part of Shale Gas Recovered from a Well to an Electrical Generator>

Next, at least part of the shale gas recovered from the wells may be supplied to an electrical generator 6 for electricity generation, and the generated electricity may be transferred to the equipment used for shale gas operation or at least to part of the equipment used for shale gas operation.

When the operation is carried out in the first shale gas well to supply shale gas, at least part of the shale gas supplied by this well may be supplied to the gas collection station 3 and may be supplied to an electrical generator 6 for electricity generation. The electricity generated by the an electrical generator 6 may be transferred to at least part of the equipment used in the shale gas operation, thereby replacing the diesel generator 5 or an external power supply used in the previous operation. By this operation, thus, the exploitation of gas by combining gas with electrical power can be achieved. The operation production may proceed continuously, avoiding the disadvantages of high energy consumption or high construction cost in contrast to when relying on only the power generated from a diesel generator or an external power supply.

The shale gas operation equipment may need an external power supply in the operation process. The shale gas operation equipment may include the first drilling machine 98 and the second drilling machine 92 used for well drilling and the electrical fracturing equipment, such as fracturing vehicle 93, perforation equipment 95, etc. used for the fracturing operation. When the shale gas produced is transferred to an electrical generator 6 and the above shale gas operation equipment is driven with the power generated, it may increase the energy efficiency during the operation.

Figure 7:
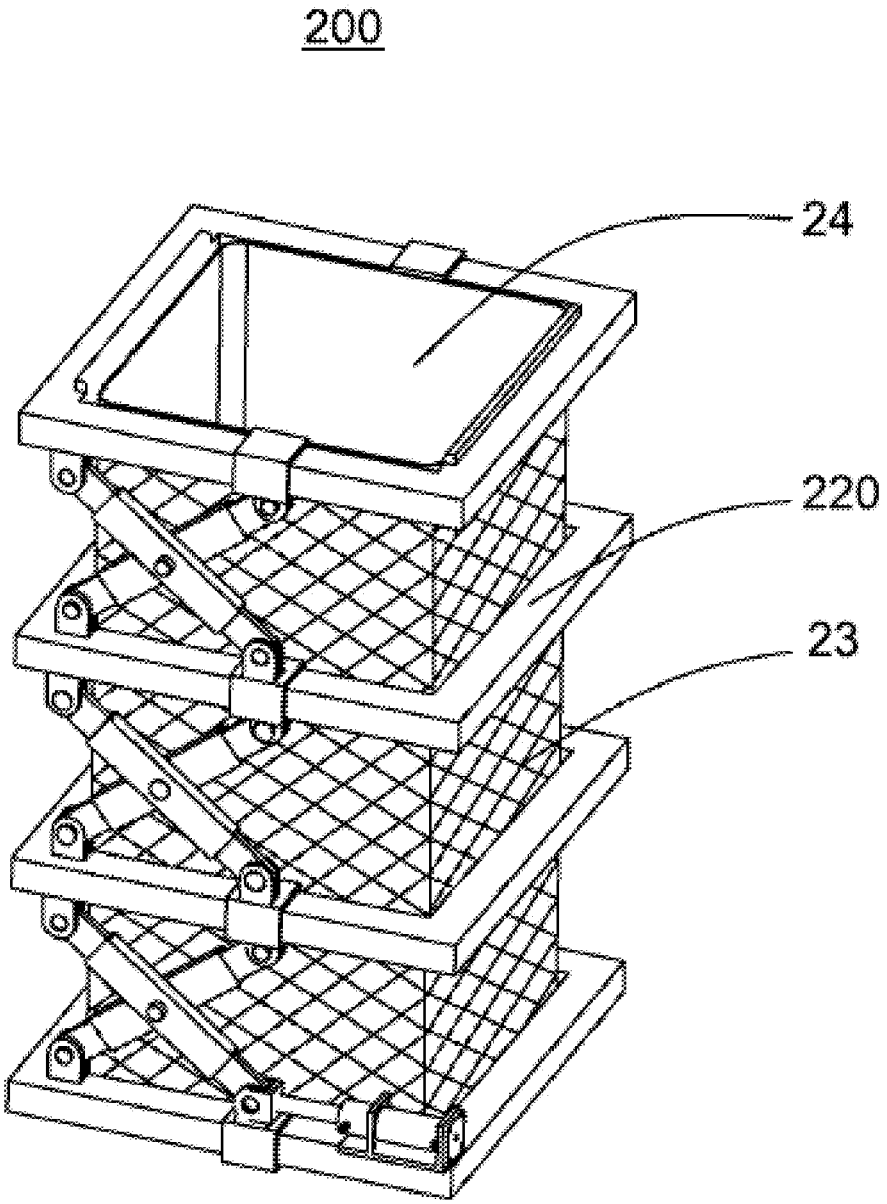
FIG. 7 illustrates a perspective view of a liquid container according to a second exemplary disclosed embodiment.

FIG. 7 illustrates a perspective view of a liquid container 200 according to a second exemplary disclosed embodiment. The second liquid container 200 may include a support structure 220, a soft, flexible capsule 24 disposed within a space defined by the support structure 220, and a net 23 disposed between the soft capsule 24 and the support structure 220. The soft capsule 24 may be similar to the soft capsule 20. The support structure 220 may include components similar to those included the support structure 10, and may be at least partially foldable.

Figure 8:
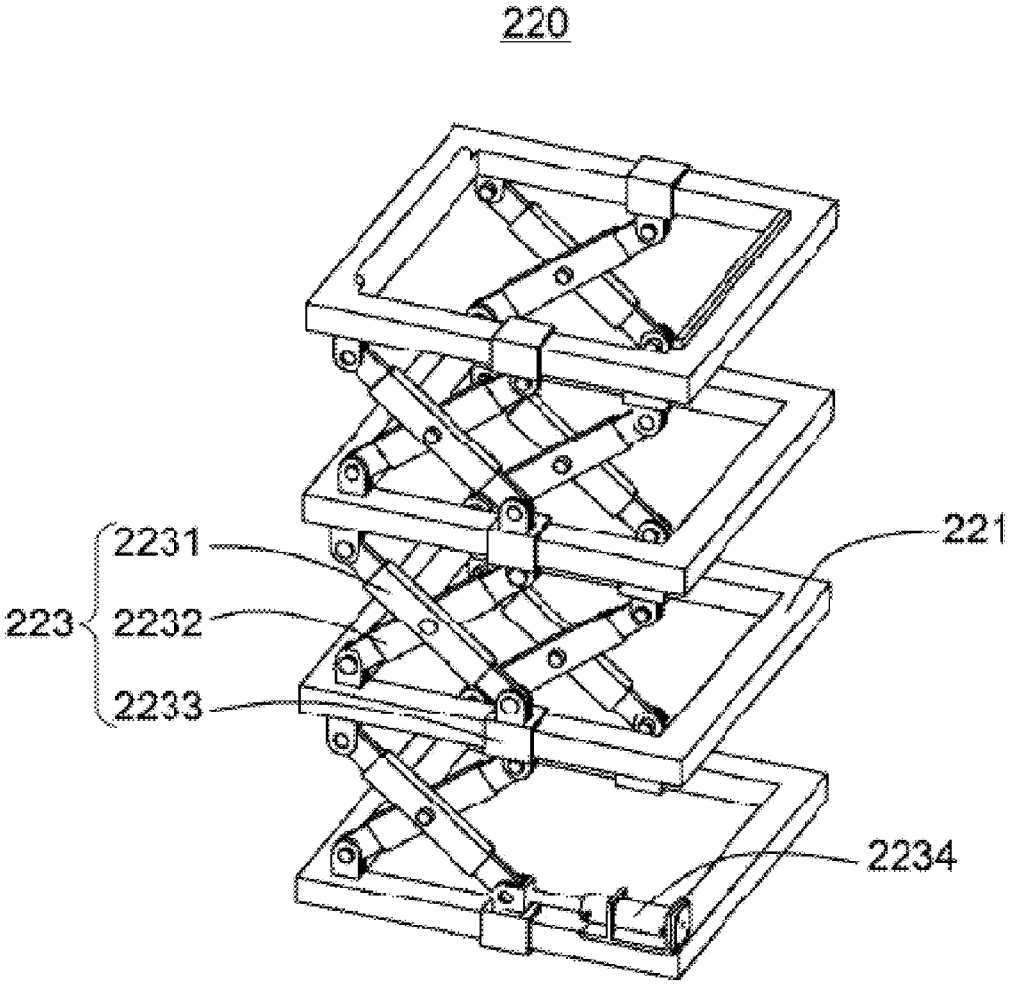
FIG. 8 illustrates a perspective view of a support structure of the liquid container of FIG. 7 according to an exemplary disclosed embodiment.

FIG. 8 illustrates a perspective view of the support structure 220 included in the liquid container 200 of FIG. 7 according to an exemplary disclosed embodiment. The support structure 220 may include a plurality of frames 221, e.g., four frames 221, stacked one above another, as shown in FIG. 8. The support structure 220 may include a plurality of foldable supporting mechanisms 223, e.g., six foldable supporting mechanisms 223, as shown in FIG. 8. It is understood that the support structure 220 may include three, four, five, or any suitable number of foldable supporting mechanisms 223.

In some embodiments, the shape and structure of the frames 221 may be substantially the same as those of the first frame 111 and the second frame 112 of the liquid container 100 shown in FIGS. 3-6. In some embodiments, the frames 221 may have shapes and structures different from those of the first and the second frames 111 and 112. For example, the shape of the frames 221 may be quadrilateral, such as, rectangular or square. It is understood that in other embodiments, the frames 221 may have a shape of a triangle, a pentagon, a hexagon, any other polygon, a circle, or an irregular shape. In the embodiments shown in FIG. 8, the four frames 221 are stacked one above another, with corresponding frame members facing each other, and are connected by the six foldable supporting mechanisms 223 disposed between pairs of two adjacent frames 221.

In the embodiment shown in FIG. 8, each of the foldable supporting mechanisms 223 connects corresponding frame members of each pair of two adjacent frames 221. Two foldable supporting mechanisms 223 are disposed between each pair of two adjacent frames 221. Each foldable supporting mechanism 223 includes a first linkage 2231, a second linkage 2232, and a sliding sleeve 2233. The structures and positions of the first linkage 2231, the second linkage 2232, and the sliding sleeve 2233 with respect to the frames 221 may be similar to those of the first linkage 121, the second linkage 122, and the second sliding sleeve 123' with respect to the first and the second frames 111 and 112, as shown in FIG. 2. The positional relationship of the first linkage 2231, the second linkage 2232, and the sliding sleeve 2233, with respect to the four frames 221, may be similar to that of the first linkage 121, the second linkage 122, and the second sliding sleeve 123' with respect to the first frame 111 and the second frame 112. Similar to the embodiment shown in FIGS. 3 and 4, the first linkage 2231 and the second linkage 2232 may each be connected to a sliding sleeve 2233 disposed on a corresponding frame 221.

As shown in FIG. 8, the support structure 220 may include a drive unit 2234 disposed on one of the plurality of frames 221, e.g., the lowest one of the frames 221. It is understood that the drive unit 2234 may be disposed on any one of the plurality of frames 221. The drive unit 2234 may be connected with one of the six foldable supporting mechanisms 223, e.g., the foldable supporting mechanism 223 connecting the lowest pair of two adjacent frames 221. The drive unit 2234 may be connected with at least one of a linkage of the foldable supporting mechanisms 223 or a sliding sleeve disposed on at least one of the frames 221. For example, the drive unit 2234 may be connected with the first linkage 2231, the second linkage 2232, or the sliding sleeve 2233. It is understood that the support structure 220 may include more than one drive unit 2234 disposed on more than one frame 221, each drive unit 2234 connected with one of the foldable supporting mechanisms 223.

In the embodiment shown in FIG. 8, the drive unit 2234 may be configured to push and pull the first linkage 2231 or the sliding sleeve 2233, thereby causing the sliding sleeve 2233 to move (e.g., slide) along a frame member of the lowest frame 221, and accordingly, causing the support structure 220 to expand or fold. The drive unit 2234 may include an end fixed to the frame member of the lowest frame 221, and another end connected with the corresponding sliding sleeve 2233 or the first linkage 2231 located on the frame side of the lowest frame 221. When the drive unit 2234 pushes the sliding sleeve 2233 away from the drive unit 2234, the movement of the sliding sleeve 2233 causes the support structure 220 to expand up in the vertical direction. When the drive unit 2234 pulls the sliding sleeve 2233 toward the drive unit 2234, the movement of the sliding sleeve 2233 causes the support structure 220 to fold down in the vertical direction.

The drive unit 2234 shown in FIG. 8 may include a hydraulic drive unit, a pneumatic drive unit, an electric motor drive unit, a piezoelectric drive unit, a chain drive unit, or any suitable drive unit. Although not shown in FIG. 8, the drive unit 2234 may include or may be connected with a power unit that supplies power to the drive unit 2234. The power unit may include a battery, solar panel, an electricity generator, etc.

Figure 9:
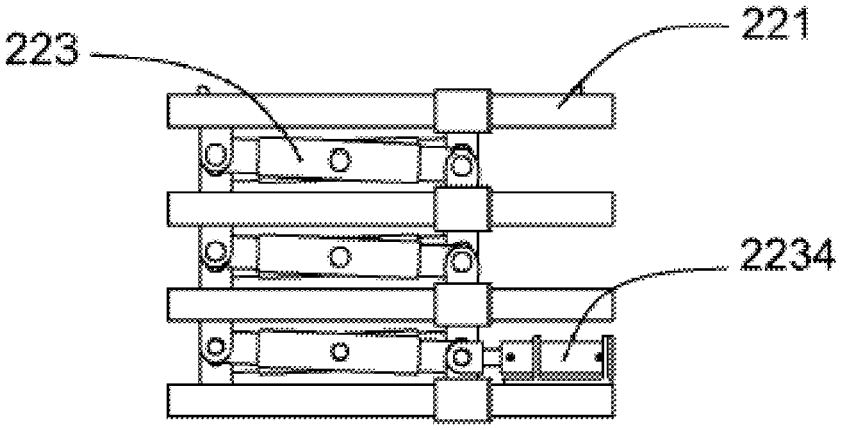
FIG. 9 illustrates a side view of the support structure of FIG. 8 in a folded state according to an exemplary disclosed embodiment.

FIG. 9 illustrates a side view of the support structure 220 in a folded state according to an exemplary disclosed embodiment. When the support structure 220 is folded, the liquid container 200 is also in a folded state, making storage and transportation of the liquid container 200 relatively easier.

The net 23 shown in FIG. 7 may be soft, flexible, or may be rigid. In one embodiment, the net 23 is flexible, and is made of a suitable flexible material, such as nylon. The net 23 may be disposed between the soft capsule 24 and the support structure 220, and may help maintain (e.g., by restraining) the soft capsule 24 within the space defined by the support structure 220, thereby preventing the soft capsule 24 from squeezing out of the space from open gaps between any pair of two adjacent frames 221 when the soft capsule 24 is filled with liquid.

In the embodiment shown in FIG. 8, the support structure 220 includes four frames 221. It is understood that the support structure 220 may include two, three, or any suitable number of frames 221. The number of the frames 221 may be determined by operational needs. The number of the foldable supporting mechanisms 223 also may vary depending on operational needs. For example, in some embodiments, the number of the foldable supporting mechanisms 223 may vary in proportion to the number of frames 221.

In this embodiment, the other features of the shale gas operation method may be substantially similar to those provided above for the first embodiment. The other structural components of liquid container 200 used for fracturing operation may be substantially similar to those provided above for the first embodiment.

Figure 10:
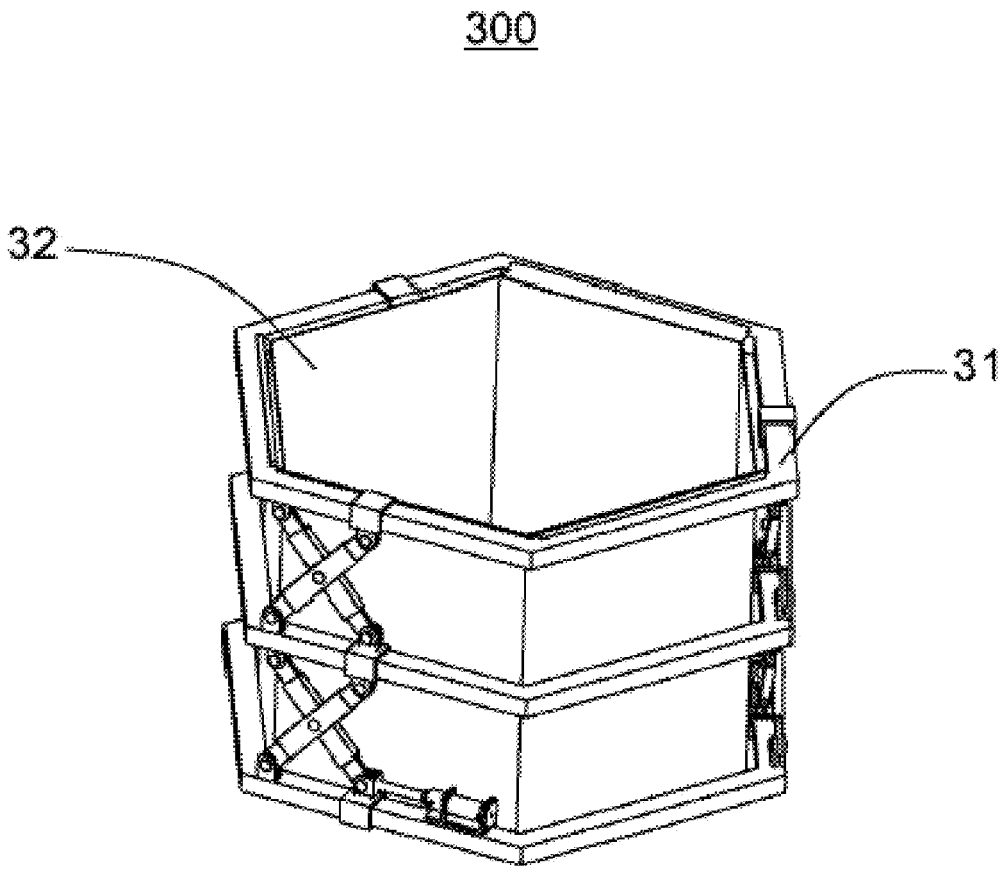
FIG. 10 illustrates a perspective view of a liquid container according to a third exemplary disclosed embodiment.
Figure 11:
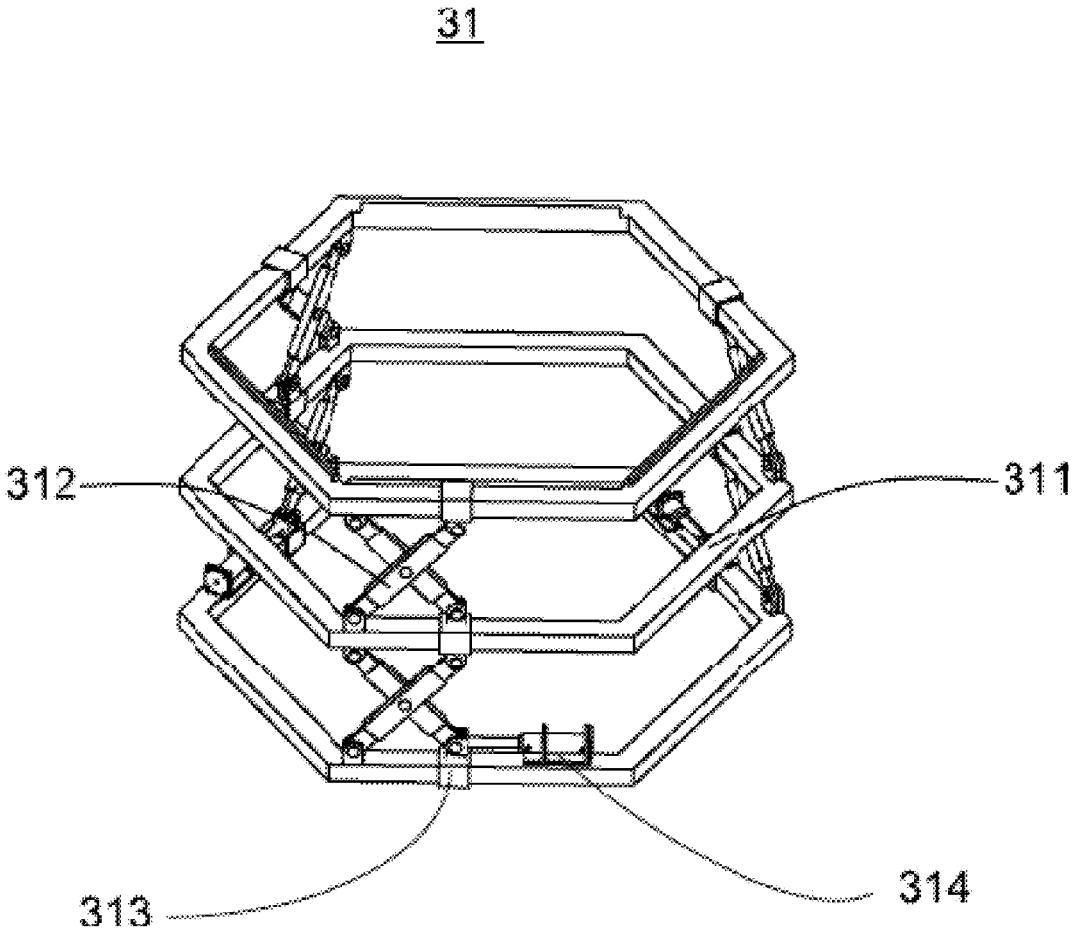
FIG. 11 illustrates a perspective view of a support structure of the liquid container of FIG. 10 according to an exemplary disclosed embodiment.
Figure 12:
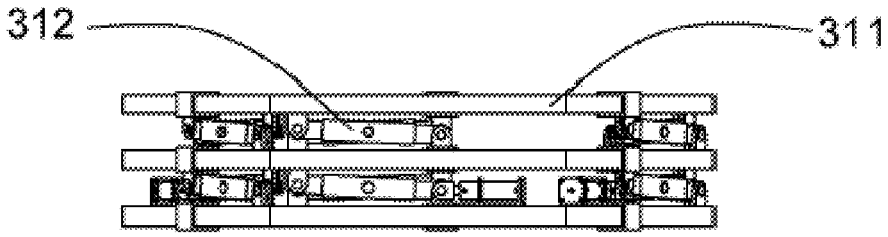
FIG. 12 illustrates a side view of the support structure of FIG. 11 in a folded state according to an exemplary disclosed embodiment.

FIG. 10 illustrates a perspective view of a liquid container 300 according to a third exemplary disclosed embodiment. The liquid container 300 may include a support structure 31 and a soft capsule 32 disposed within a space defined by the support structure 31 for storing liquid. The liquid container 300 may include other components similar to those included in the liquid containers 100 and 200. FIG. 11 illustrates a perspective view of the support structure 31 in an expanded state, and FIG. 12 illustrates a side view of the support structure 31 in a folded state, according to exemplary disclosed embodiments. The support structure 31 may be at least partially foldable and may include components similar to those included in the support structures 10 or 220.

Referring to FIG. 11, the support structure 31 may include three frames 311 and six foldable supporting mechanisms 312. It is understood that the support structure 31 may include any suitable number of frames 311 and foldable supporting mechanisms 312. One difference between the first and second embodiments shown in FIGS. 3-9 and the embodiment shown in FIG. 11 is that the shape of the frames 311 is hexagon. The frames 311 are stacked together and connected by the foldable supporting mechanisms 312, with corresponding frame members facing each other.

As shown in FIG. 11, each of the foldable supporting mechanisms 312 connects a pair of two adjacent frames 311. Three foldable supporting mechanisms 312 are provided in this embodiment to connect a pair of two adjacent frames 311. In the embodiment shown in FIG. 11, the three foldable supporting mechanisms 312 are distributed on every other pair of frame members. It is understood that more or lesser number of foldable supporting mechanisms 312 may be provided to connect each pair of two adjacent frames 311.

The structural and positional relationship of each of the foldable supporting mechanisms 312 with respect to the frames 311 may be similar to those discussed above with respect to the foldable supporting mechanisms 223 and the frames 221 of the liquid container 200 shown in FIGS. 7-9. For example, the support structure 31 may include a plurality of sliding sleeves 313. The support structure 31 may also include a plurality of drive units 314 located on the lowest frame 311, each drive unit 314 being associated with one of the foldable supporting mechanisms 223. The drive units 313 may drive the sliding sleeves 313 to move along corresponding frame members of the frames 311, thereby causing the support structure 31 to expand or fold. FIG. 12 illustrates a side view of the support structure 31 of FIG. 11 in a folded state according to an exemplary disclosed embodiment. When the support structure 31 is folded, the size of the support structure 31 is reduced, thereby making storage and transportation easier.

In the embodiment shown in FIG. 11, the support structure 31 includes three frames 311. It is understood that the number of frames may vary depending on operational needs. Any suitable number of frames may be included in the support structure 31. Although FIG. 11 shows that the support structure 31 includes six foldable supporting mechanisms 312, it is understood that the support structure 31 may include any suitable number of foldable supporting mechanisms 312. In addition, although three sliding sleeves 313 and three drive units 314 are shown in FIG. 11, it is understood that the number of the sliding sleeves 313 and the drive units 314 may vary with the number of the foldable supporting mechanisms 312. The support structure 31 may include more or less number of sliding sleeves 313 and drive units 314.

In this embodiment, the other features of the shale gas operation method may be substantially similar to those provided above for the second exemplary disclosed embodiment. The other structural components of liquid container 300 used for fracturing operation may be substantially similar to those provided above for the second exemplary disclosed embodiment.

Figure 13:
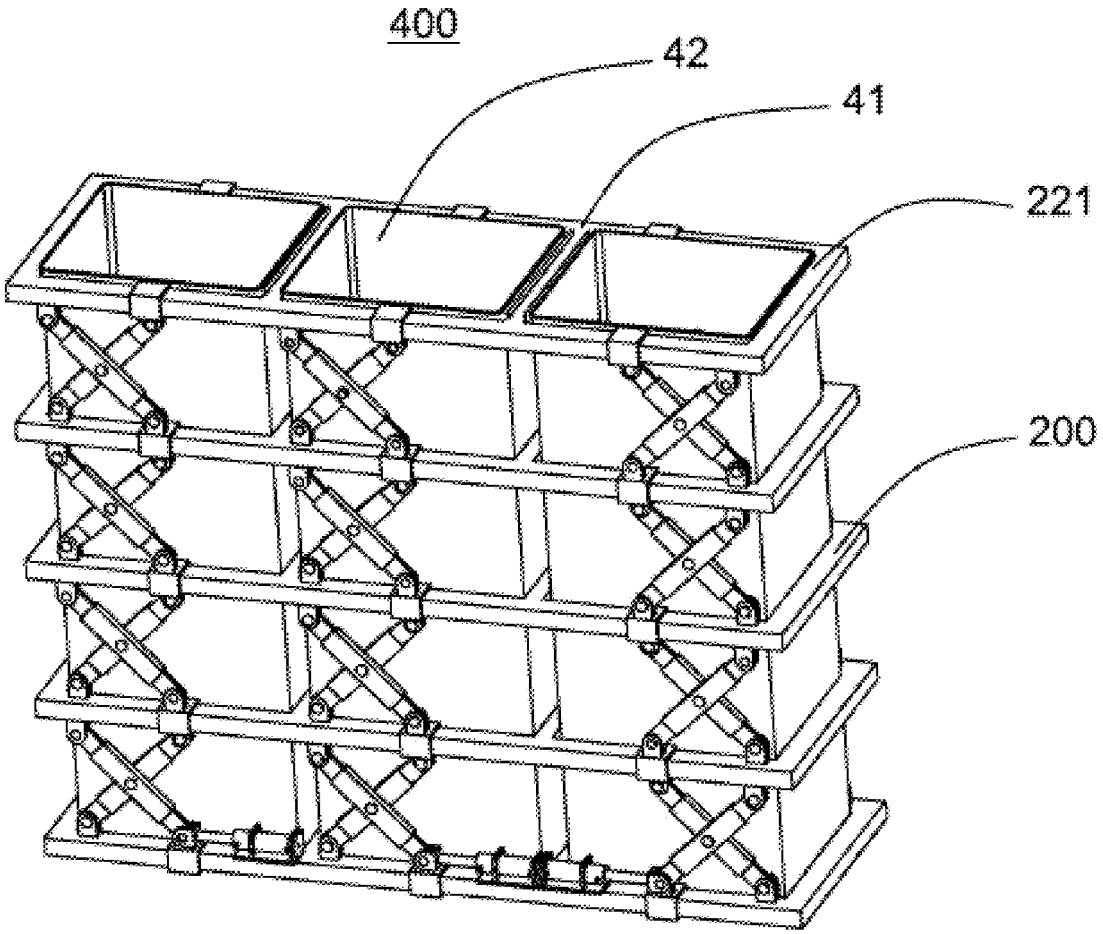
FIG. 13 illustrates a perspective view of a liquid container according to a fourth exemplary disclosed embodiment.

FIG. 13 illustrates a perspective view of a liquid container 400 according to a fourth exemplary disclosed embodiment. The liquid container 400 may include at least one support structure 41 and at least one soft capsule 42 disposed within a space defined by the at least one support structure 41 for storing liquid. In one embodiment, the liquid container 400 may include an assembly of separate liquid containers, e.g., three as shown in FIG. 13. The three separate liquid containers may be connected together, each of which may be structurally similar to the liquid container 200, and each of which may define a space for accommodating a soft capsule 42. In another embodiment, the liquid container 400 may include a single support structure 41 having a plurality of (e.g., three, as shown in FIG. 13) divided spaces, each space accommodating a soft capsule 42. The single support structure 41 may be at least partially foldable and may include components similar to those included in the support structure 10, the support structure 220, or the support structure 31.

The liquid container 400 may include a plurality of frames 221, e.g., five, as shown in FIG. 13, stacked one above another in a vertical direction. In the embodiment shown in FIG. 13, the liquid container 400 may include a single support structure 41 including five frames 221 stacked in the vertical direction and having a space defined by the single support structure 41 divided into three subspaces, each subspace accommodating a soft capsule 42. In other embodiments, the liquid container 400 may include the single support structure 41 including any suitable number of frames 221 in the vertical direction. The liquid container 400 may include a space defined by the single support structure 41 divided into any suitable number of, e.g., four, five, six, etc., subspaces, each accommodating a soft capsule 42.

In some embodiments, the liquid container 400 may include three liquid containers 200 connected in series in a horizontal direction, each having a support structure 41 with five frames 221 stacked in the vertical direction and a soft capsule 42 disposed within the space defined by the support structure 41. The number of the liquid containers 200 and/or the number of the soft capsules 42 may vary according to operational needs, and may be any suitable number, e.g., four, five, six, etc. The number of frames 221 may vary according to operational needs, which may be any suitable number, e.g., six, seven, eight, etc.

In some embodiments, the liquid container 400 may include an assembly of the liquid containers 100 or the liquid containers 300 arranged in a manner similar to that discussed above with respect to FIG. 13. In other embodiments, the liquid container 400 may include an assembly of a combination of the liquid containers 100, 200, and 300.

In this embodiment, the other features of the shale gas operation method may be substantially similar to those provided above for the third exemplary disclosed embodiment. The other structural components of liquid container 200 used for fracturing operation may be substantially similar to those provided above for the third exemplary disclosed embodiment.

Figure 14:
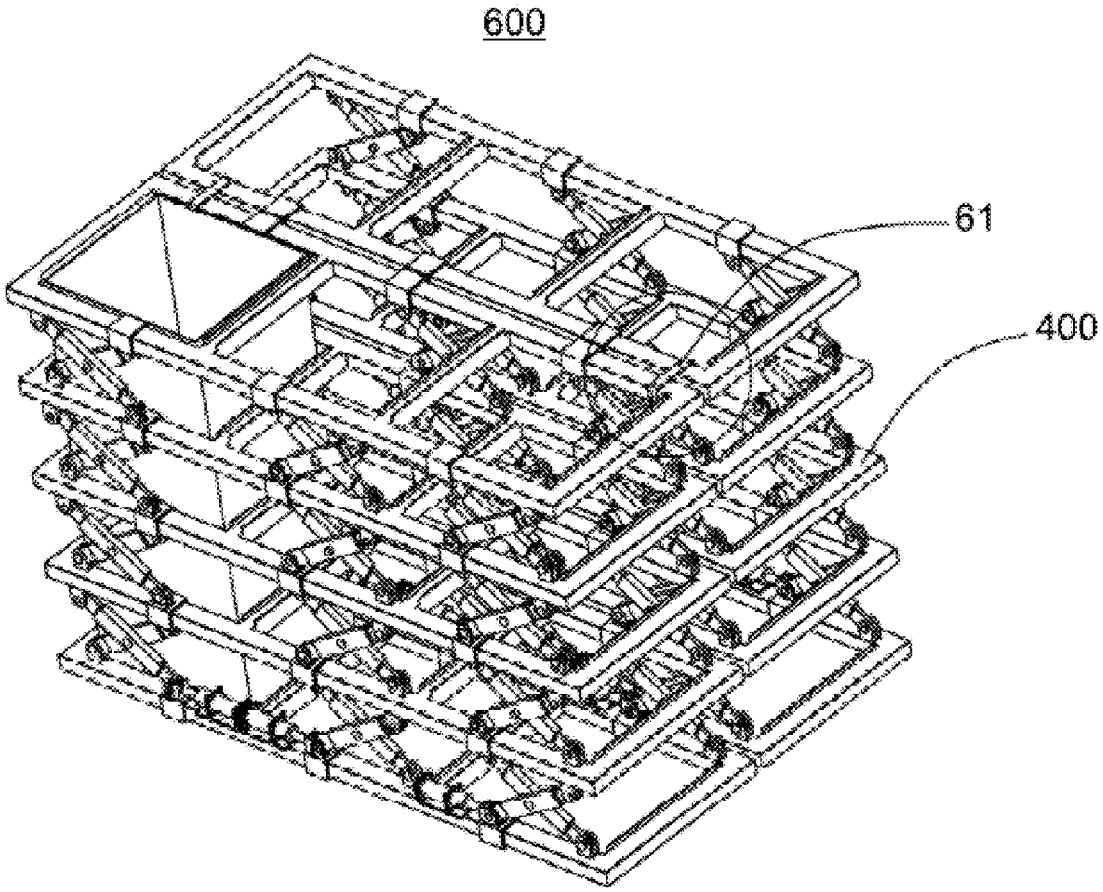
FIG. 14 illustrates a perspective view of a liquid container assembly including two liquid containers shown in FIG. 13 connected together according to an exemplary disclosed embodiment.
Figure 15:
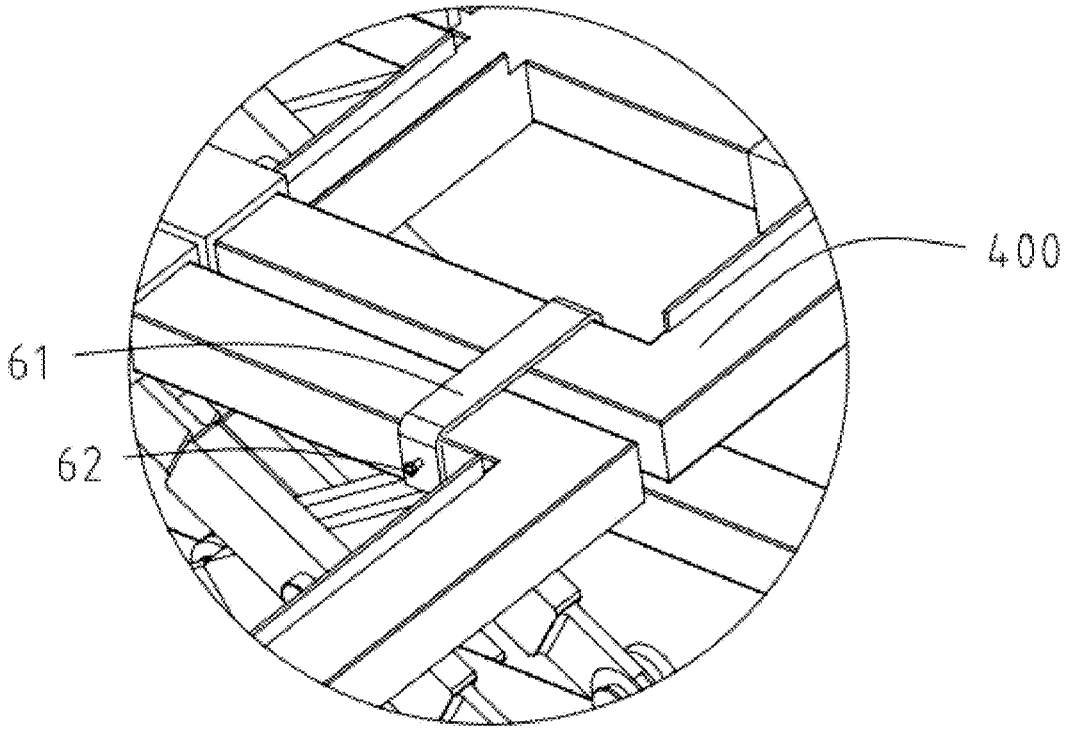
FIG. 15 illustrates an enlarged view of a portion of the liquid container assembly shown in FIG. 14 according to an exemplary disclosed embodiment.
Figure 16:
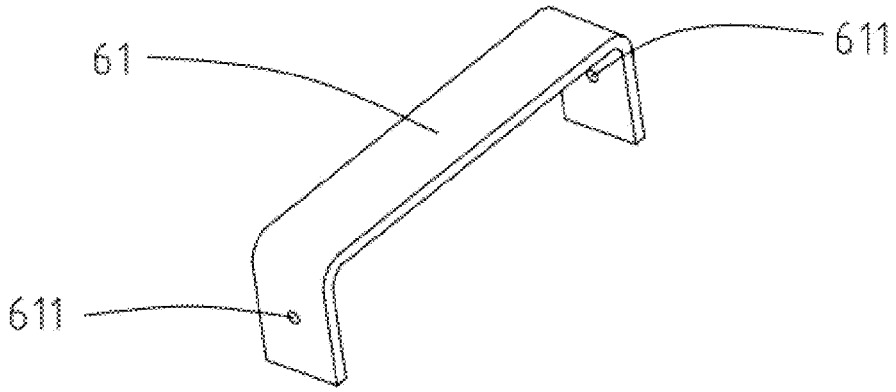
FIG. 16 illustrates a perspective view of a connector that connects the two liquid containers shown in FIG. 15 according to an exemplary disclosed embodiment.

FIG. 14 illustrates a perspective view of a liquid container assembly 600 including two liquid containers 400 shown in FIG. 13 connected together according to an exemplary disclosed embodiment. The two liquid containers 400 may be arranged side by side and connected by one or more connectors 61. FIG. 15 illustrates an enlarged view of a portion of the liquid container assembly 600, showing in detail the connection of the two liquid containers 400 by the one or more connectors 61 according to an exemplary disclosed embodiment. FIG. 16 illustrates a perspective view of an example of the one or more connectors 61 according to a disclosed embodiment. The one or more connectors 61 may include any suitable connector, such as a bracket, a clamp, etc. In the embodiment shown in FIGS. 15 and 16, each of the one or more connectors 61 may include a bracket having a U-shape, with each vertical side of the bracket having at least one hole 611 for receiving at least one screw 62.

The one or more connectors 61 may be placed across two adjacent frame members of the two liquid containers 400 arranged side by side, as shown in FIG. 15. The at least one screw 62 may secure the one or more connectors 61 to the two adjacent frame sides of the two liquid containers 400, thereby holding the two liquid containers 400 together to form the liquid container assembly 600. It is understood that other suitable connection means may also be implemented to connect the two liquid containers 400. In some embodiments, the liquid container assembly 600 may include any other suitable number of liquid containers 400, e.g., three, four, five, etc., connected together by suitable connection means, such as, the one or more connectors 61 and the at least one screw 62. In some embodiments, the liquid containers 400 may be replaced by at least one of the liquid containers 100, 200, or 300 to form the liquid container assembly 600. In other embodiments, the liquid container assembly 600 may include a combination of the liquid containers 100, 200, 300, and/or 400 connected together by suitable connection means.

In this embodiment, the other features of the shale gas operation method may be substantially similar to those provided above for the first embodiment. The other structural components of liquid container 600 used for fracturing operation may be substantially similar to those provided above for the third embodiment.

Figure 17:
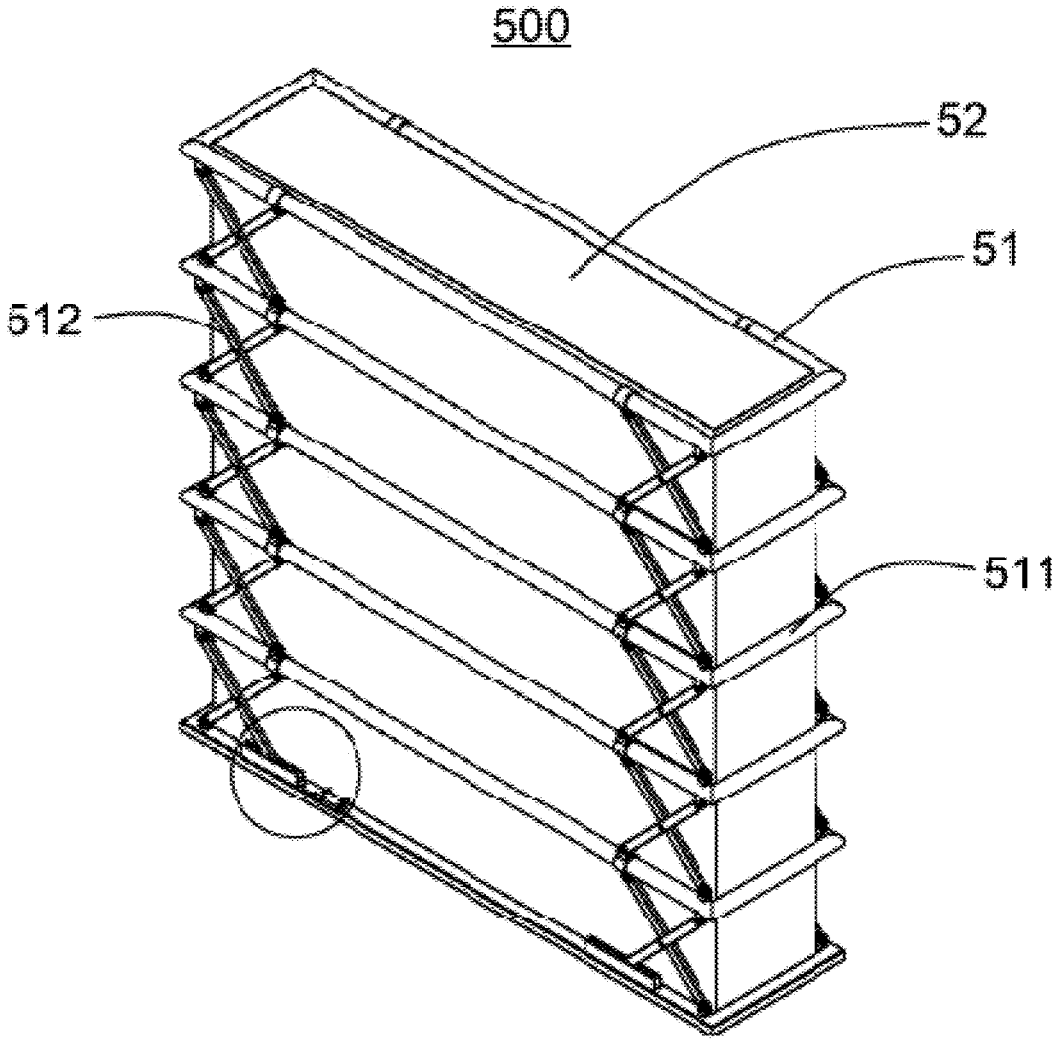
FIG. 17 illustrates a perspective view of a liquid container according to a fifth exemplary disclosed embodiment.

FIG. 17 illustrates a perspective view of a liquid container 500 according to a fifth exemplary disclosed embodiment. The liquid container 500 may include components similar to those included in the liquid containers 100, 200, 300, 400, and/or the liquid container assembly 600. The liquid container 500 may include a support structure 51 and a soft capsule 52 disposed within a space defined by the support structure 51 for storing liquid. The support structure 51 may include a plurality of, e.g., six as shown in FIG. 17, frames 511. The support structure 51 may include a plurality of, e.g., twenty, foldable supporting mechanisms 512, each connecting a pair of two adjacent frames 511. It is understood that the support structure 51 may be at least partially foldable and may include components similar to those included in the support structures 10, 220, 31, or 41.

As shown in FIG. 17, the six frames 511 are stacked one above another in a vertical direction with corresponding frame members facing each other. The six frames 511 are separated and connected by the foldable supporting mechanisms 512. Four foldable supporting mechanisms 512 are disposed between each pair of two adjacent frames 511. The structure and components of the foldable supporting mechanisms 512 may be similar to the foldable supporting mechanisms 12 and/or 223 discussed above. In one embodiment, the foldable supporting mechanisms 512 may include sliding sleeves that may be similar to the sliding sleeves 123, 123', and/or 2233 discussed above.

Figure 18:
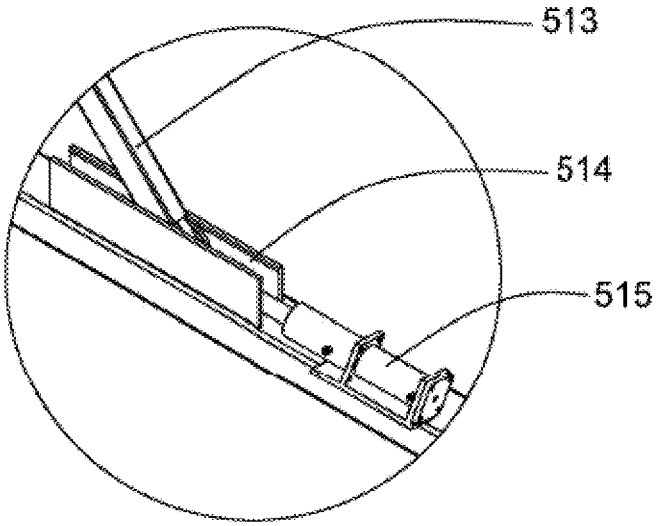
FIG. 18 illustrates an enlarged view of a portion of the liquid container shown in FIG. 17 according to an exemplary disclosed embodiment.
Figure 19:
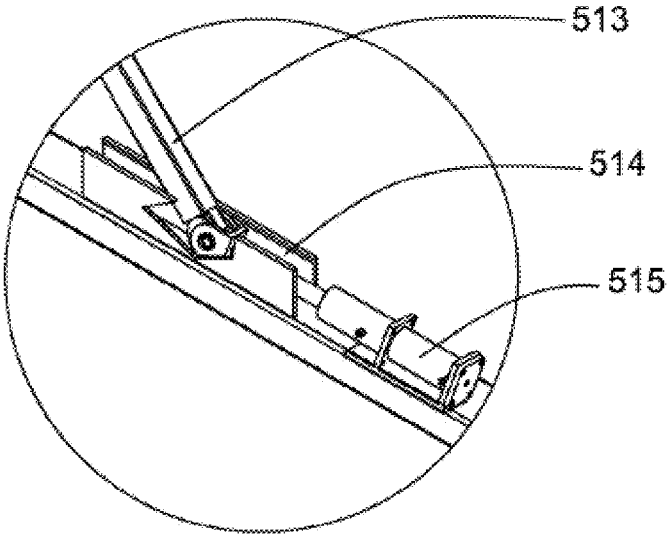
FIG. 19 illustrates a regional broken-out sectional view of the portion of the liquid container shown in FIG. 18 according to an exemplary disclosed embodiment.

FIG. 18 illustrates an enlarged view of a portion of the liquid container 500 shown in FIG. 17. FIG. 19 illustrates a regional broken-out sectional view of the portion of the liquid container 500 shown in FIG. 18 according to an exemplary disclosed embodiment. In the embodiment shown in FIGS. 18 and 19, a linkage 513 included in one of the foldable supporting mechanisms 512 (such as the one located on the lowest frame 511) may be connected to a corresponding frame member through a sliding track 514 rather than a sliding sleeve. The sliding track 514 may be disposed on one of the plurality of frames 511, e.g., on a frame member of the lowest frame 511. An end of the linkage 513 may be slidably disposed within or on the sliding track 514 in such a manner that the end of the linkage 513 may slide along the sliding track 514. The end of the linkage 513 may also be connected to a drive unit 515. It is understood that the number of the sliding tracks 514 may vary according to operational needs, and the foldable supporting mechanisms 512 may include any suitable number, e.g., one, two, three, four, etc., of sliding tracks 514. The foldable supporting mechanisms 512 may include a combination of sliding tracks and sliding sleeves. For example, the foldable supporting mechanisms 512 may include one sliding track 514 disposed at the lowest frame 511, and a plurality of sliding sleeves disposed on other suitable frames. The number of drive unit 515 may also vary in accordance with the number of sliding tracks and/or sliding sleeves.

The drive unit 515 shown in FIG. 18 may drive the linkage 513 to slide along the sliding track 514 relative to the corresponding frame 511, so as to cause the liquid container 500 to expand or fold. When the liquid container 500 is in a folded state, storage and transportation of the liquid container 500 is facilitated and the cost associated with the storage and transportation is reduced.

In this embodiment, the other features of the shale gas operation method may be substantially similar to those provided above for the first embodiment. The other structural components of liquid container 500 used for fracturing operation may be substantially similar to those provided above for the fourth embodiment.

Figure 20:
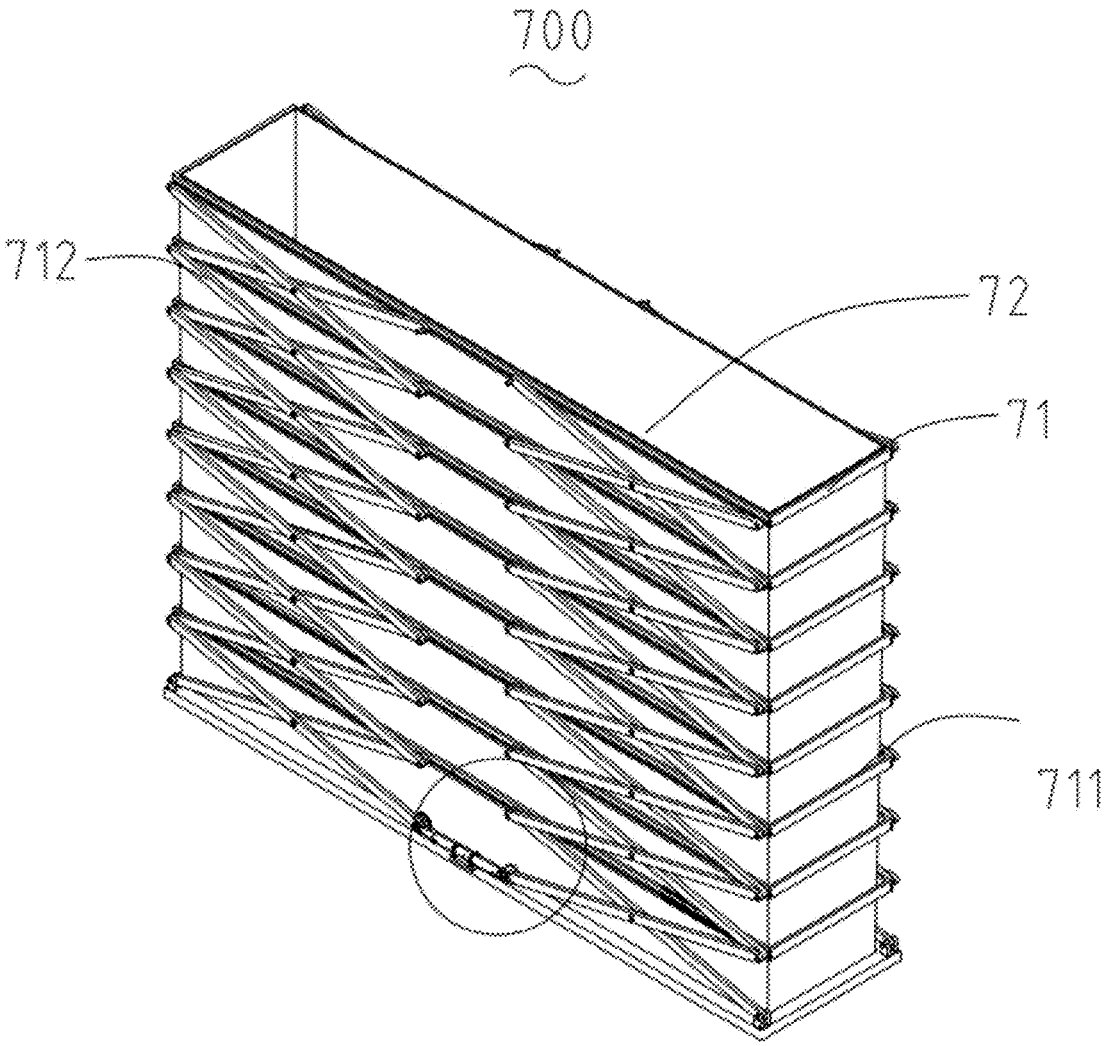
FIG. 20 illustrates a perspective view of a liquid container according to a sixth exemplary disclosed embodiment.

FIG. 20 illustrates a perspective view of a liquid container 700 according to a sixth exemplary disclosed embodiment. The liquid container 700 may include components similar to those included in the liquid containers 100, 200, 300, 400, 500, and/or the liquid container assembly 600. The liquid container 700 may include a support structure 71 and a soft capsule 72 disposed within a space defined by the support structure 71 for storing liquid. The support structure 71 may include a plurality of, e.g., nine, frames 711. It is understood that the support structure 71 may include any suitable number of frames 711, e.g., more or less than nine. The support structure 71 may include a plurality of, e.g., thirty two, foldable supporting mechanisms 712. It is understood that the support structure 71 may include any suitable number of foldable supporting mechanisms 712, e.g., more or less than thirty two. The support structure 71 may be at least partially foldable and may include components similar to those included in the support structures 10, 220, 31, 41, or 51.

In the embodiment shown in FIG. 20, the nine frames 711 are stacked one above another, with corresponding frame members facing each other. The nine frames 711 are separated and connected by the foldable supporting mechanisms 712. Each of the foldable supporting mechanisms 712 connects corresponding frame members of a pair of two adjacent frames 711. Each pair of two adjacent frames 711 are connected by four foldable supporting mechanisms 712. It is understood that each pair of two adjacent frames 711 may be connected by any suitable number of foldable supporting mechanisms 712, e.g., more or less than four.

The foldable supporting mechanisms 712 shown in FIG. 20 may include one or more sliding sleeves that may be similar to the sliding sleeves 123, 123', and/or 2233 discussed above.

Additionally or alternatively, the foldable supporting mechanisms 712 may include one or more sliding tracks that may be similar to the sliding track 514 discussed above. In some embodiments, the foldable supporting mechanisms 712 may include a combination of sliding sleeves and sliding tracks.

Figure 21:
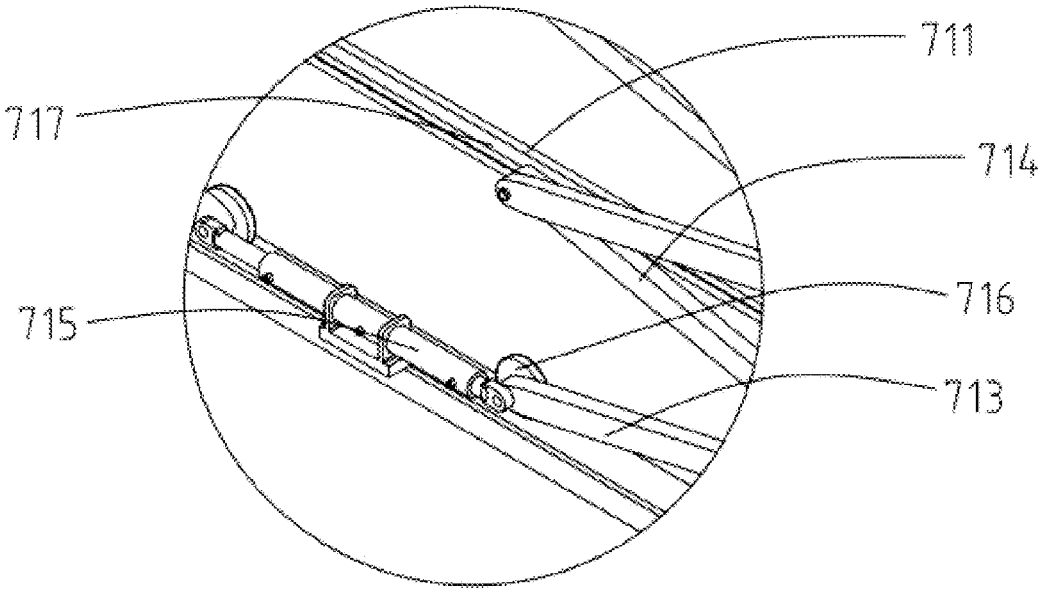
FIG. 21 illustrates an enlarged view of a portion of the liquid container shown in FIG. 20 according to an exemplary disclosed embodiment.
Figure 22:
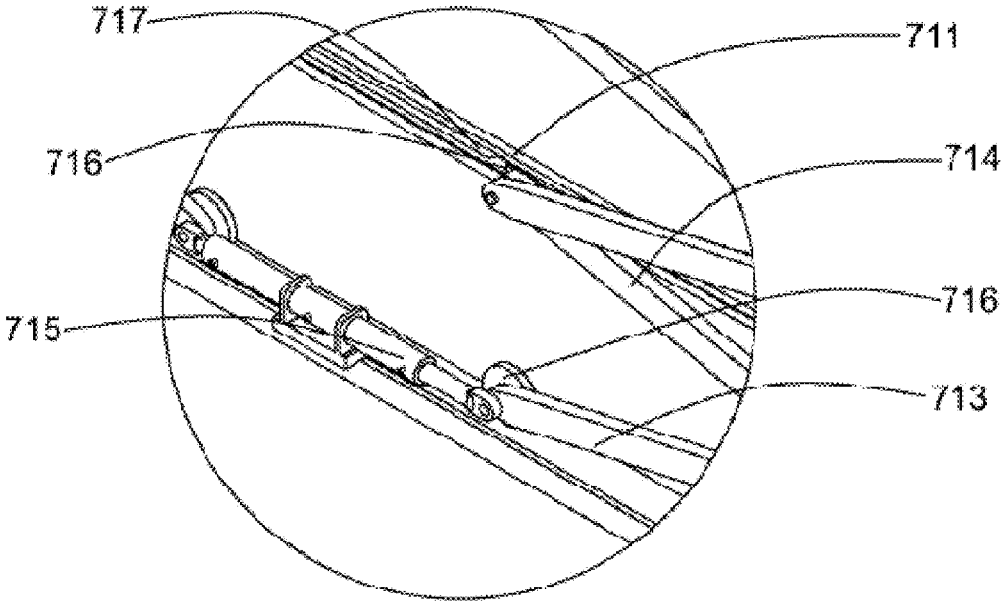
FIG. 22 illustrates a regional broken-out sectional view of the portion of the liquid container shown in FIG. 21 according to an exemplary disclosed embodiment.

FIG. 21 illustrates an enlarged view of a portion of the liquid container 700 shown in FIG. 20. FIG. 22 illustrates a regional broken-out sectional view of the portion of the liquid container 700 shown in FIG. 21 according to an exemplary disclosed embodiment. As shown in FIG. 21, at least one of the foldable supporting mechanisms 712 may include a first linkage 713, a second linkage 714. Connection between the first and the second linkages 713 and 714 and the corresponding frame 711 may utilize a sliding track 717 rather than sliding sleeves. The sliding track 717 may be disposed on a frame member of a corresponding frame 711. At least one of the first linkage 713 and the second linkage 714 may include an end connected with a roller 716 disposed within the sliding track 717, as shown in FIGS. 21 and 22. The first linkage 713 may include another end connected to the drive unit 715. The drive unit 715 may drive the first linkage 713 to slide, through the roller 716, within the sliding track 714 relative to the corresponding frame 711, when the liquid container 700 is expanded or folded. When the liquid container 700 is folded, the storage and transportation of the liquid container 700 is facilitated and the cost associated with the storage and transportation is reduced.

In this embodiment, the other features of the shale gas operation method may be substantially similar to those provided above for the first embodiment. The other structural components of liquid container 700 used for fracturing operation may be substantially similar to those provided above for the fifth embodiment.

Figure 23:
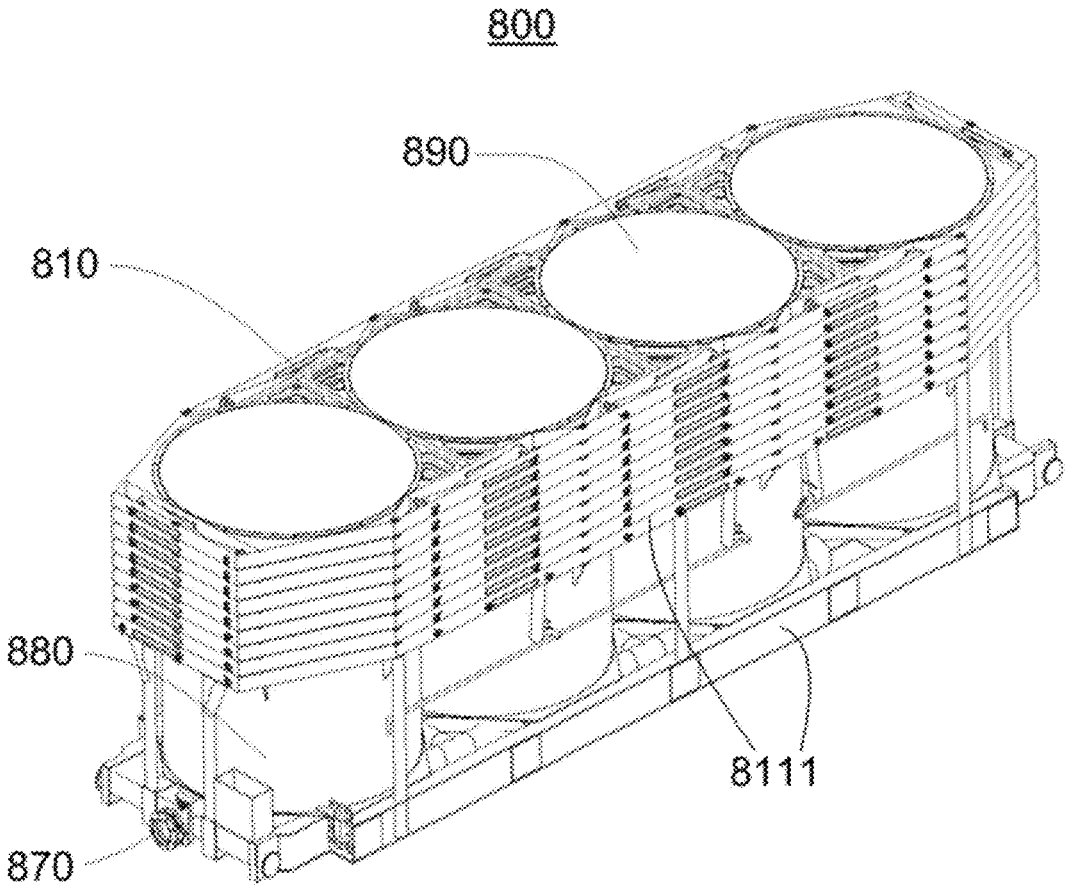
FIG. 23 illustrates a perspective view of a liquid container in a folded state according to a seventh exemplary disclosed embodiment.
Figure 24:
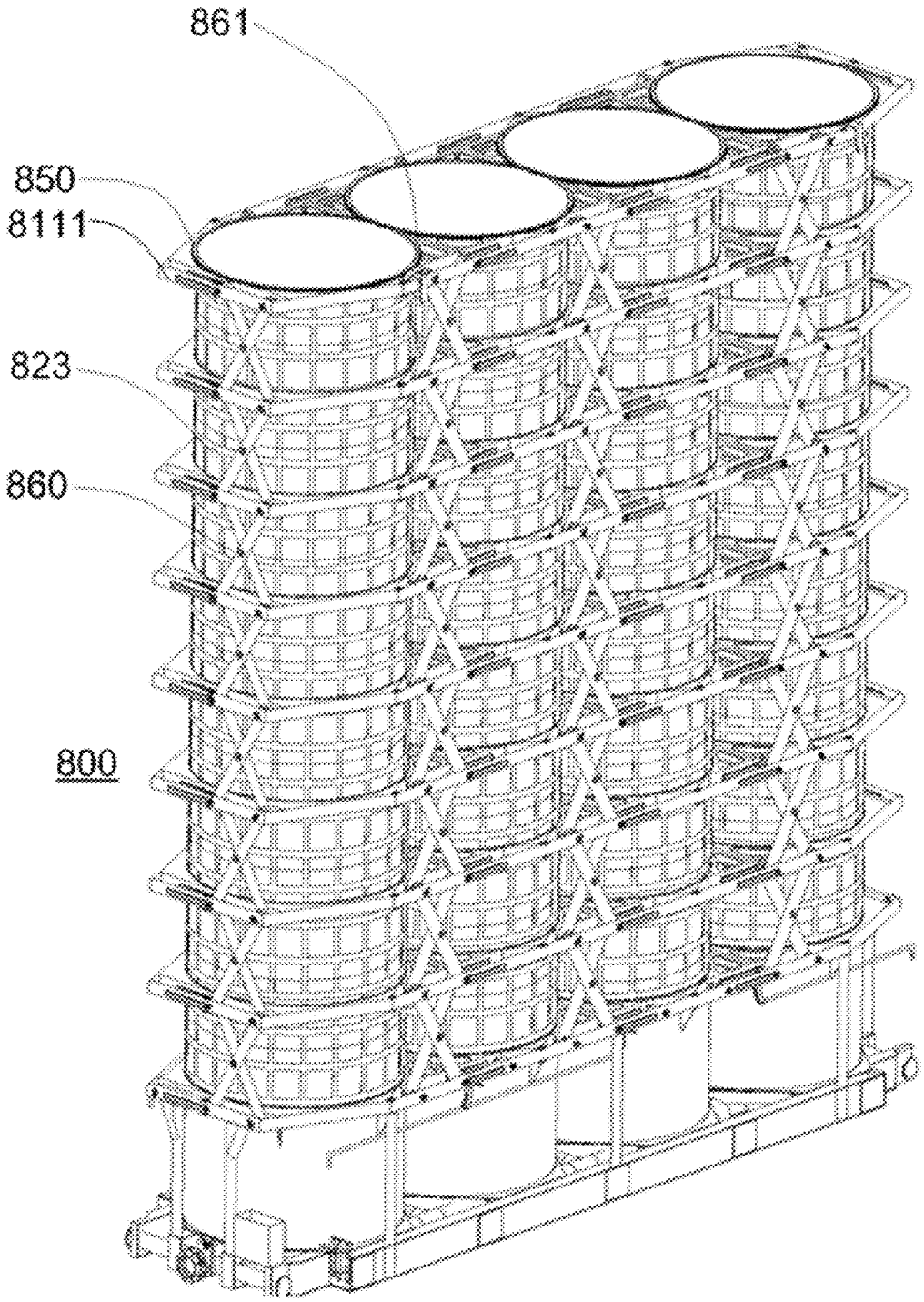
FIG. 24 illustrates a perspective view of the liquid container shown in FIG. 23 in an expanded state according to an exemplary disclosed embodiment.
Figure 25:
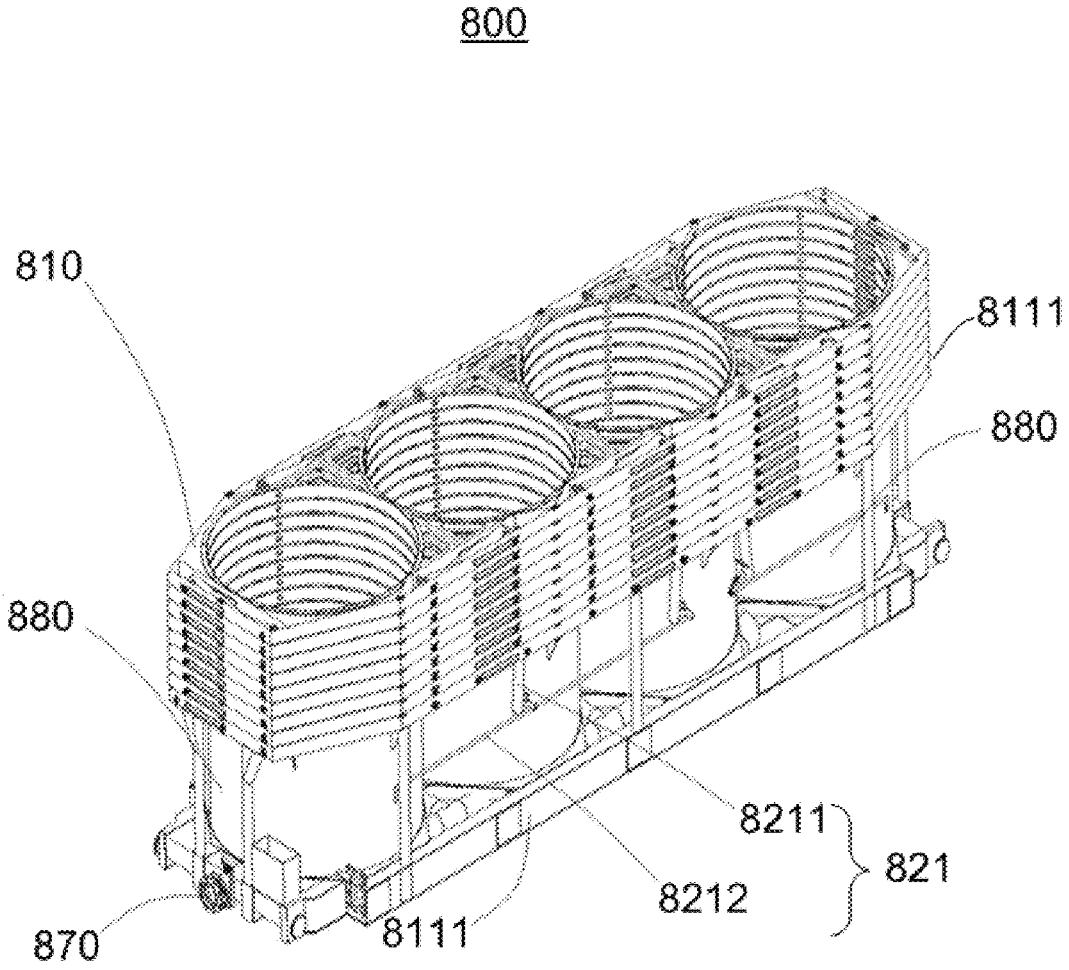
FIG. 25 illustrates a perspective view of the liquid container shown in FIG. 23 with a support structure in a folded state according to an exemplary disclosed embodiment.
Figure 26:
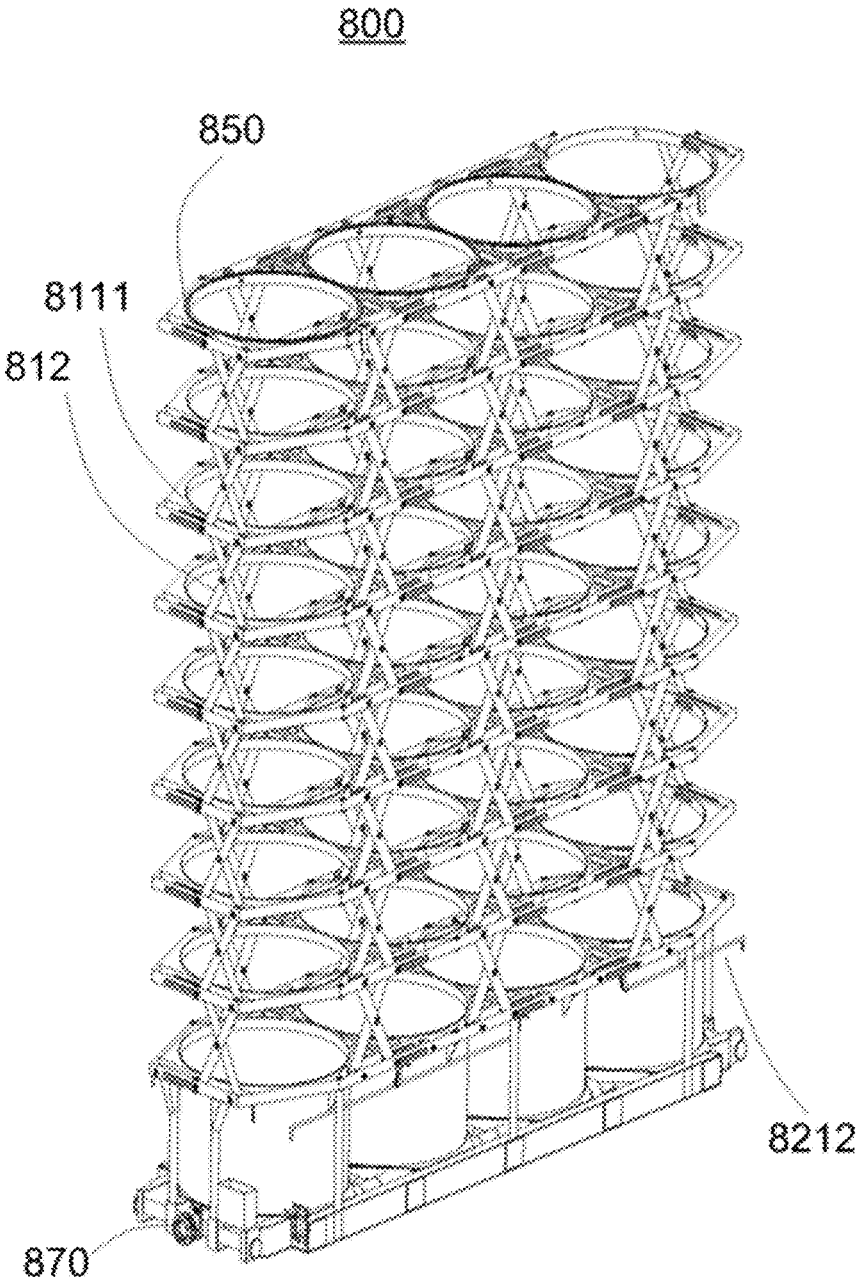
FIG. 26 illustrates a perspective view of the liquid container shown in FIG. 23 with the support structure in an expanded state according to an exemplary disclosed embodiment.
Figure 27:
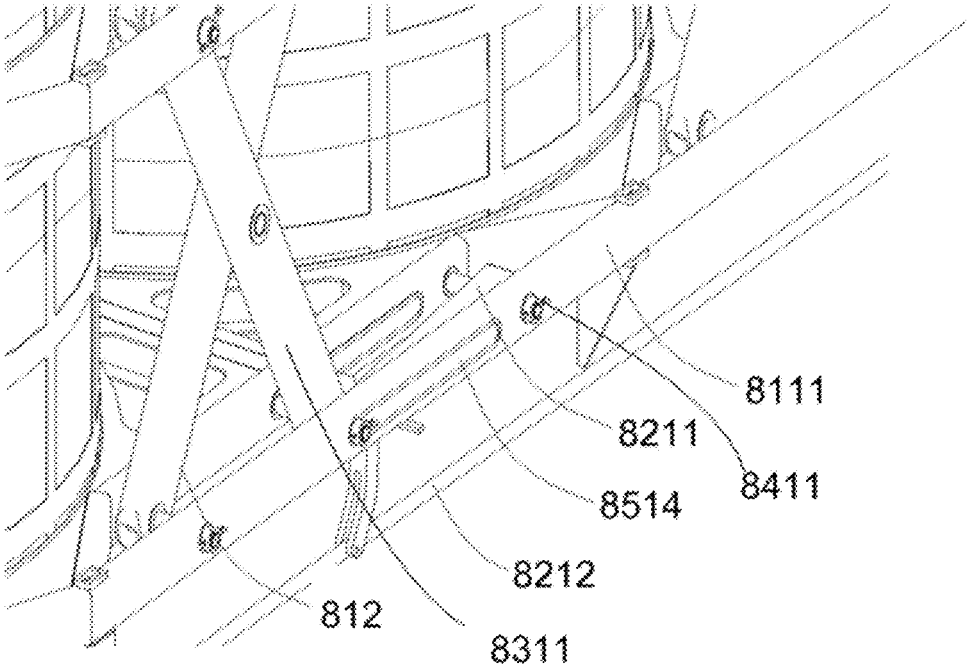
FIG. 27 illustrates an enlarged view of a frame and a locking mechanism of the liquid container shown in FIG. 23 according to an exemplary disclosed embodiment.
Figure 28:
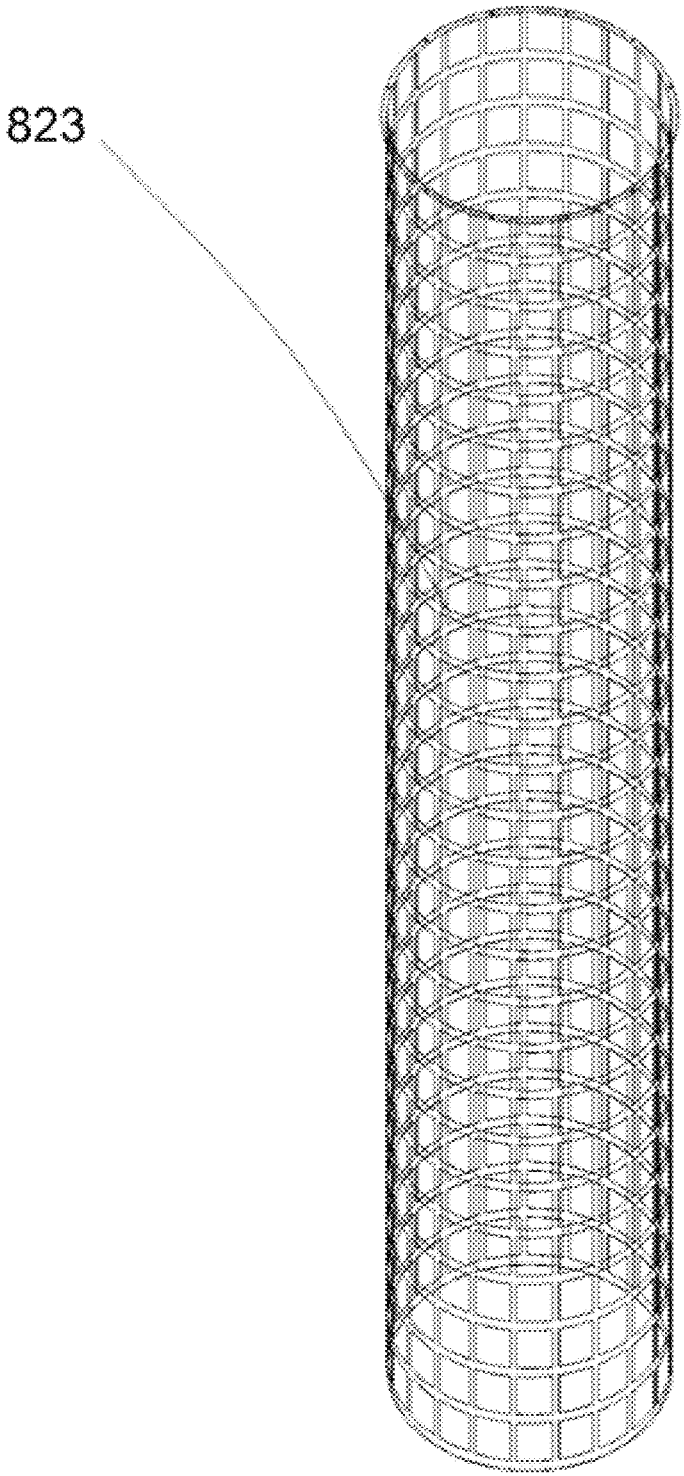
FIG. 28 illustrates a net which may be implemented with the liquid container shown in FIG. 23 according to an exemplary disclosed embodiment.
Figure 29:
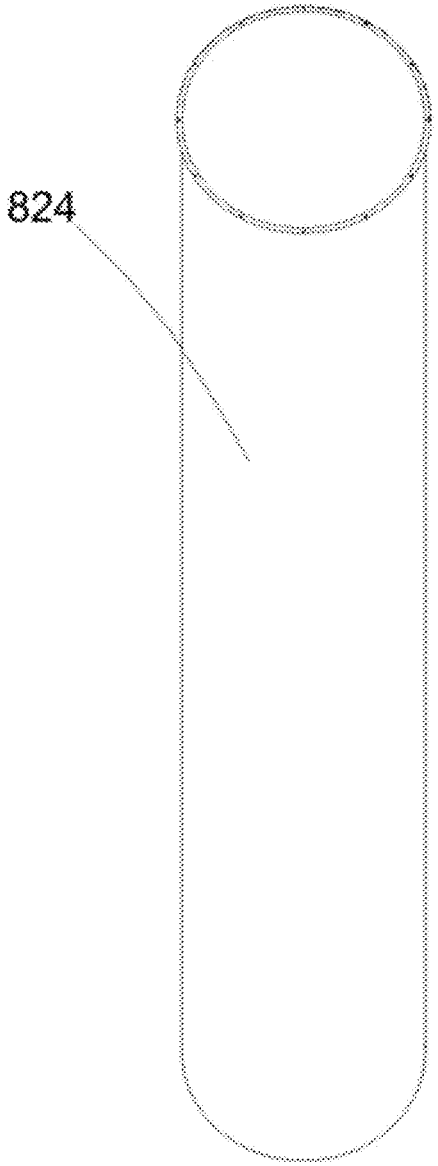
FIG. 29 illustrates a soft capsule which may be implemented with the liquid container shown in FIG. 23 according to an exemplary disclosed embodiment.

Now refer to FIGS. 23-33. FIG. 23 illustrates a perspective view of a liquid container 800 in a folded state according to a seventh exemplary disclosed embodiment. FIG. 25 illustrates a perspective view of the liquid container 800 in an expanded state. The liquid container 800 may include components similar to those included in the liquid containers 100, 200, 300, 400, 500, the liquid container assembly 600, and/or the liquid container 700. As shown in FIG. 23, the liquid container 800 may include a support structure 810 and a base support 880. The base support 880 may be provided at a bottom portion of a plurality of frames 8111. The base support 880 may include at least one receiving bucket 890 with a cylindrical shape disposed in the vertical direction. In the embodiment shown in FIG. 23, the base support 880 includes four receiving buckets 890. It is understood that the base support 880 may include any suitable number of receiving buckets 890, e.g., one, two, three, etc. Each of the receiving buckets 890 may be a rigid container for storing a net 823 (an exemplary embodiment of the net 823 is shown in FIG. 28) and a soft capsule 824 (an exemplary embodiment of the soft capsule 824 is shown in FIG. 29). The total number of nets 823 or soft capsules 824 may be the same as the total number of the receiving buckets 890. For example, in the embodiment shown in FIG. 23, the liquid container 800 includes four nets 823 and four soft capsules 824.

The soft capsule 824 shown in FIG. 29 may be at least partially stored within the receiving bucket 890. The soft capsule 824 may include an opening at a top portion (similar to the embodiment shown in FIG. 3). Circumferential portions of the top portion of the soft capsule 824 may be secured to a top portion of the receiving bucket 890 through any suitable mechanism, e.g., clamp, screw, elastic band, etc. The soft capsule 824 may include a ring structure 850 (shown in FIG. 24), which may secure the circumferential portions of the top portion of the soft capsule 824 to a top portion of the support structure 810, such as, for example, a top frame 8111, by press-fitting, clamping, or any other suitable means. The ring structure 850 may also secure circumferential portions of a top portion of the net 823 to a top portion of the support structure 810, such as, for example, a top frame 8111. The ring structure 850 may have a shape that matches the shape of the opening of the soft capsule 824 or the opening of the receiving bucket 890.

The base support 880 shown in FIG. 23 may include at least one hose 870 disposed at a bottom portion of the base support 880. The hose 870 may be connected with the soft capsule 824 disposed within the receiving bucket 890. The soft capsule 824 may include at least one inlet for allowing a flow of liquid into the soft capsule 824. The hose 870 may be connected with the at least one inlet. The hose 870 may include a fluid height measuring device configured to measure a height of liquid contained in the soft capsule 824. In order to facilitate deposition of solid matters, such as sand, dirt, rocks, at the bottom portion of the soft capsule 824, the bottom of the receiving bucket 890 may have an upside down cone shape, such as a shape similar to that of a funnel.

The net 823 shown in FIG. 28 may include a shape substantially matching that of an inner wall of the support structure 810. For example, in one embodiment, the shape of the net 823 and that of the inner wall of the support structure 810 may both be cylindrical. The net 823 may include, at an outer surface, one or more flexible strips 860 (shown in FIG. 24). The flexible strips 860 may help the net 823 to stay within the space defined by the support structure 810. When the net 823 is being folded in the vertical direction, e.g., when the liquid container 800 is being folded, the flexible strip 860 may help the folded net 823 stay within the space defined by the support structure 810, thereby preventing a portion of the net 823 being caught between the gap of a pair of two adjacent frames 8111 when the pair of two adjacent frames 8111 are brought closer to each other. The soft capsule 824 may be disposed within the net 823, which may restrain the radial expansion of the soft capsule 824 when the soft capsule 824 is filled with liquid. Accordingly, the forces exerted by the expanded soft capsule 824 on the support structure 810 may be reduced, which may in turn reduce the deformation of the support structure 810, thereby prolonging the life of the support structure 810 and enhancing the safety and reliability of the liquid container 800.

FIG. 25 illustrates a perspective view of the liquid container 800 with the support structure 810 in a folded state, and FIG. 26 illustrates a perspective view of the liquid container 800 with the support structure 810 in an expanded state. The support structure 810 may include a foldable supporting mechanism 812. The support structure 810 may be at least partially foldable and may include components similar to those included in the support structures 10, 220, 31, 41, 51, or 71. The foldable supporting mechanism 812 may include components similar to those included in the foldable supporting mechanisms 12, 12', 223, 312, 512, and/or 712.

The liquid container 800 may include a locking mechanism 821, as shown in FIG. 25. The locking mechanism 821 may be configured to lock/unlock the position of the foldable supporting mechanism 812 relative to the frames 8111. When the position of the foldable supporting mechanism 812 is locked by the locking mechanism 821, the support structure 810 may be maintained in an expanded state. The locking mechanism 821 may include a position locking bar 8211 and a pulling link 8212.

FIG. 27 illustrates an enlarged view of the frame 8111 and the locking mechanism 821 of the liquid container 800. The position locking bar 8211 may be connected with at least one of the frames 8111 through a fixing shaft or rod 8411. The foldable supporting mechanism 812 may include a linkage 8311. When the foldable supporting mechanism 812 is in an expanded state, a user may adjust the position of the position locking bar 8211 such that a moveable end of the position locking bar 8211 is positioned at a first position within a moving path or range of an end of the linkage 8311 along the at least one frames 8111. When the moveable end of the position locking bar 8211 is positioned at the first position, the moveable end of the position locking bar 8211 may block or limit the movement of the linkage 8311, thereby locking the position of the foldable supporting mechanism 812 in a desired expanded, open state. When the moveable end of the position locking bar 8211 is positioned at a second position out of the moving range or path of the end of the linkage 8311, the movement of the linkage 8311 is unblocked or allowed.

Similar to the embodiments shown in FIGS. 4 and 18, the linkage 8311 may be connected to the at least one of the frames 8111 through a sliding sleeve that may be similar to the sliding sleeve 123, or through a sliding track that may be similar to the sliding track 514, or a combination of both a sliding sleeve and a sliding track. When the linkage 8311 is connected with the at least one of the frames 8111 through a sliding sleeve that may be similar to the sliding sleeve 123, the moveable end of the position locking bar 8211 may be rotated to be at a locking position within the moving range of the sliding sleeve. The moveable end may block or limit the movement of the sliding sleeve and the linkage 8311. Accordingly, the position locking bar 8211 may lock the position of the foldable supporting mechanism 812 relative to the at least one of the frames 8111, and the liquid container 800 may be maintained in an expanded state.

When the foldable supporting mechanism 812 is to be folded, the moveable end of the position locking bar 8211 may be rotated to an unlocking position away from or out of the moving range or moving path of the sliding sleeve, such that the moveable end of the position locking bar 8211 does not interfere with the movement of the sliding sleeve and the linkage 8311. Accordingly, the sliding sleeve and the linkage 8311 may be moved along the at least one of the frames 8111, thereby unlocking the position of the foldable supporting mechanism 812, and enabling the support structure 810 to be folded.

In some embodiments, the foldable supporting mechanism 812 may be connected with the at least one of the frames 8111 through a sliding track 8514 that may be similar to the sliding track 514, as shown in FIG. 19. In such embodiments, the moveable end of the position locking bar 8211 may be rotated such that the moveable end is within the moving range of a sliding part (e.g., a roller that may be similar to the roller 716 shown in FIG. 21) of the linkage 8311 within the sliding track 8514. In order to maintain the foldable supporting mechanism 812 in an expanded state, after the moveable end of the position locking bar 8211 is rotated to be the locking position within the moving range of the sliding part of the linkage 8311, the moveable end of the position locking bar 8211 is positioned to contact the sliding part of the linkage 8311, as shown in FIG. 27, thereby blocking the movement of the linkage 8311.

As shown in FIG. 27, the pulling link 8212 that is connected to the position locking bar 8211 may be used to help cause rotation of the position locking bar 8211 to realize position locking and unlocking of the foldable supporting mechanism 812. For example, after the liquid container 800 has been expanded to a working open state, the pulling link 8212 may be pulled or pushed to cause the position locking bar 8211 to rotate until the moveable end of the position locking bar 8211 is moved to the locking position within the moving range of the moving part of the linkage 8311. The moveable end of the position locking bar 8211 may then be positioned to block the movement of the linkage 8311 along the at least one of the frames 8111, thereby locking the position of the foldable supporting mechanism 812 relative to the at least one of the frames 8111. When the liquid container 800 needs to be folded, e.g., for storage or transportation, the pulling link 8212 may be pulled or pushed to cause the position locking bar 8211 to rotate such that the moveable end of the position locking bar 8211 is moved to the unlocking position away from or out of the moving path or moving range of the moving part of the linkage 8311. Accordingly, the moveable end of the position locking bar 8211 does not interfere with the movement of the linkage 8311, thereby unlocking the position of the foldable supporting mechanism 812. The foldable supporting mechanism 812 then may be folded for storage or transportation.

The liquid container 800 shown in FIG. 24 may include at least one first connector 861 for connecting various parts of the support structure 810. For example, the liquid container 800 may be an assembly of a plurality of (e.g., four) liquid containers connected side by side by the at least one first connector 861, which may include any suitable connectors for connecting parts of the support structure 810, such as, for example, screws, brackets, clamps, bolts, nuts, chains, etc. For example, in some embodiments, the at least one first connector 861 may include components similar to the one or more connectors 61 and/or the at least one screw 62 discussed above in connection with FIGS. 14-16.

FIG. 28 illustrates the net 823 according to an exemplary disclosed embodiment. The net 823 may be similar to the net 23 discussed above in connection with FIG. 7. FIG. 29 illustrates the soft capsule 824 according to an exemplary disclosed embodiment. The soft capsule 824 may be similar to the soft capsule 20 discussed above in connection with FIG. 5.

Figure 30:
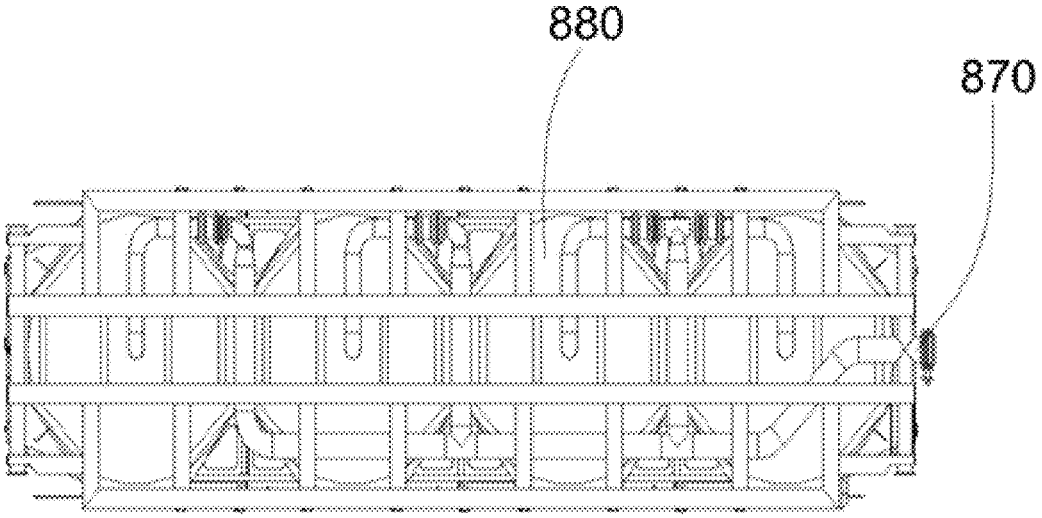
FIG. 30 illustrates an bottom view of the liquid container shown in FIG. 23 according to an exemplary disclosed embodiment.
Figure 31:
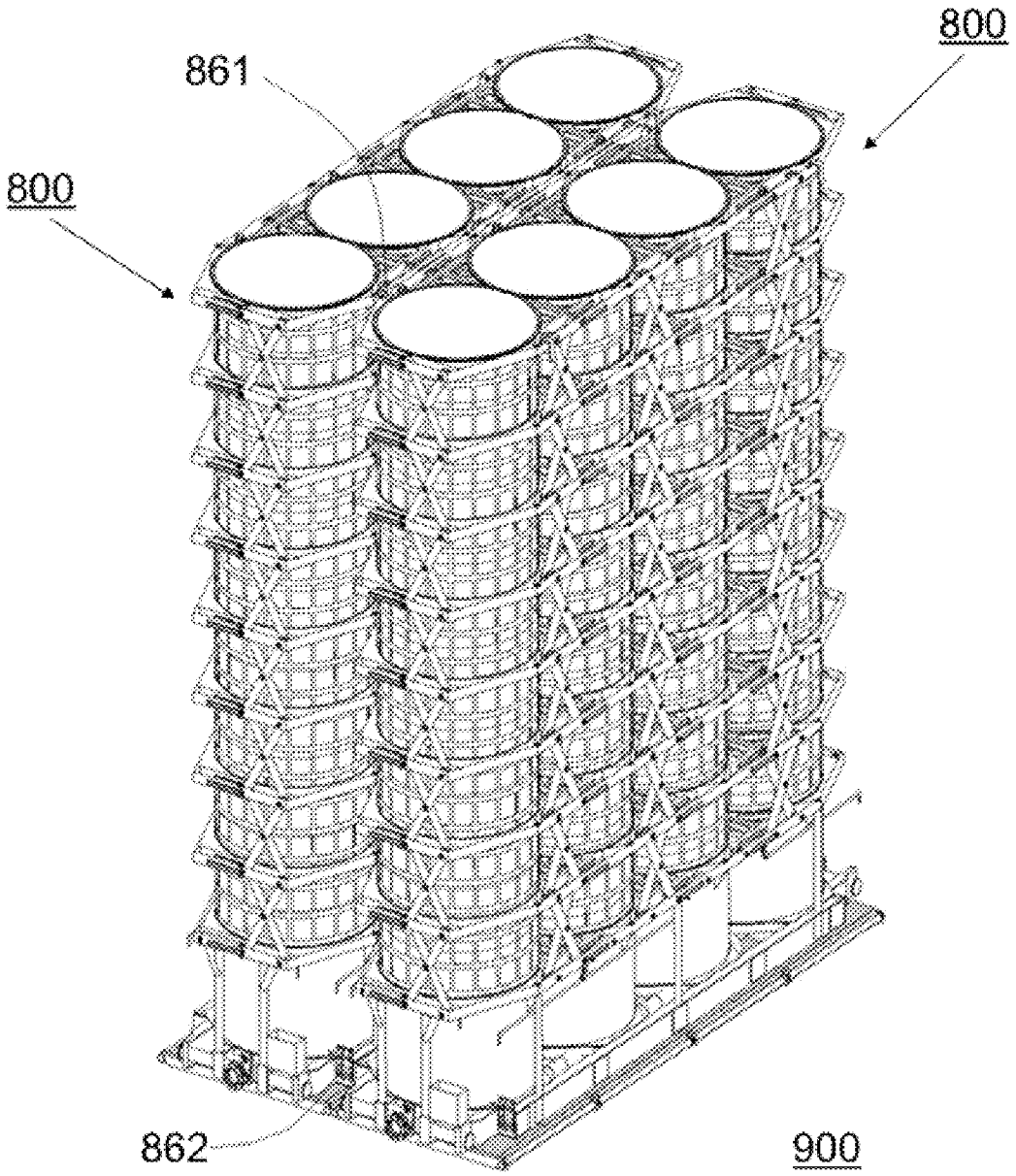
FIG. 31 illustrates a liquid container assembly including two liquid containers shown in FIG. 23 connected together according to an exemplary disclosed embodiment.

FIG. 30 illustrates a bottom view of the liquid container 800 according to an exemplary disclosed embodiment. The hose 870 may be provided at a bottom portion of the base support 880. FIG. 31 illustrates a liquid container assembly 900 including two liquid containers 800 connected together according to an exemplary disclosed embodiment. The liquid containers 800 may be connected by the at least one first connector 861 and at least one second connector 862. The at least one first connector 861 may be configured for connecting top portions of the liquid containers 800, and the at least one second connector 862 may be configured for connecting bottom portions of the liquid containers 800. The at least one second connector 862 may include any suitable connectors, such as, for example, screws, brackets, clamps, bolts, nuts, chains, etc.

Figure 32:
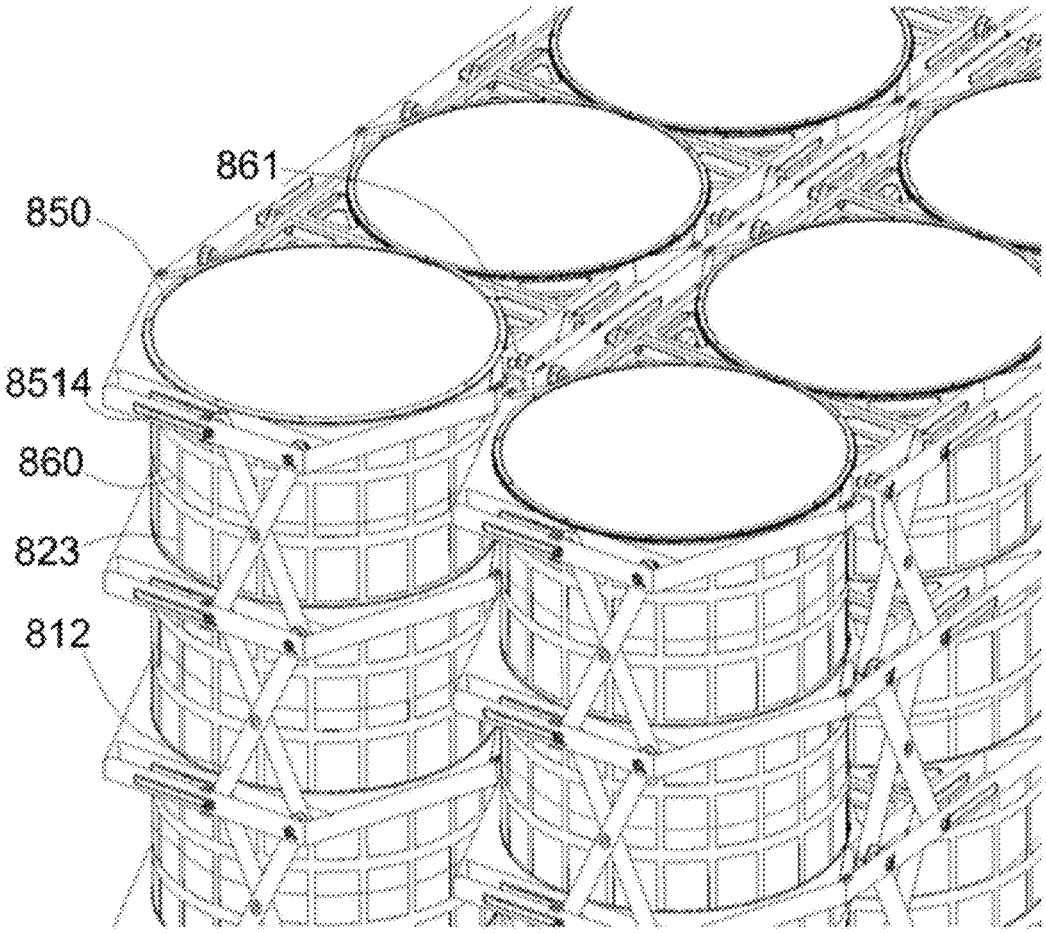
FIG. 32 illustrates a top enlarged perspective view of the liquid container assembly shown in FIG. 31 according to an exemplary disclosed embodiment.
Figure 33:
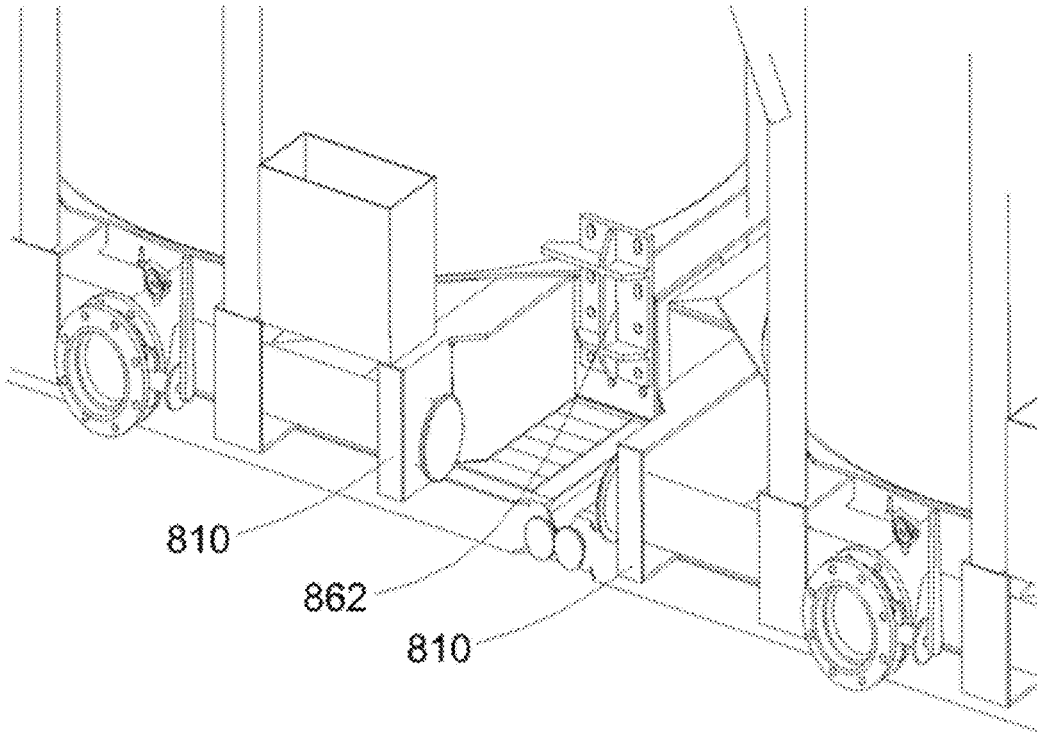
FIG. 33 illustrates a bottom enlarged perspective view of the liquid container assembly shown in FIG. 31 according to an exemplary disclosed embodiment.

FIG. 32 illustrates a top view of the liquid container assembly 900 according to an exemplary disclosed embodiment, and FIG. 33 illustrates an enlarged view of a bottom portion of the liquid container assembly 900 showing an exemplary embodiment of the at least one second connector 862. The at least one second connector 862 may include plates and screws, or any other suitable securing means, for securely connecting the support structures 810 of the two liquid containers 800.

In this embodiment, the other features of the shale gas operation method may be substantially similar to those provided above for the second exemplary disclosed embodiment. The other structural components of liquid container 800 used for fracturing operation may be substantially similar to those provided above for the fifth exemplary disclosed embodiment.

Referring to FIG. 1A, 1B, & FIG. 2A-2D, in some embodiments, the shale gas operation method includes the following features.

Drilling a plurality of shale gas wells may be performed. Initially, at a first well location, a substantially straight vertical well section 90 may be drilled with the first drilling machine 98. The first drilling machine may be substantially the same as that provided for the first embodiment. After the straight well section is drilled, the first drilling machine 98 may be moved to a next well location 9 and the above straight well operation may be performed at a next well location.

Directional drilling may be carried out with the first drilling machine 98 from the straight well section made in the previous step. Once completed, the well may be secured with low-density cement. Afterwards a horizontal well operation is completed to form a horizontal well section 91 from the vertical well section 90. The first drilling machine 98 of the first well location may be moved to carry out the horizontal well drilling of the next well section 9.

A fracturing operation may be carried out. And, a perforation operation may be carried out via hydraulic sand blasting. A perforation tool 950 may be connected to hydraulic sand blast perforation equipment 95. The hydraulic sand blast perforation may be carried out by injecting water containing sand particles at a high pressure, e.g., 12 MPa, out of a spraying nozzle, such as perforation tool 950 at a speed of 190 m/s. To accelerate the perforation rate, fine sand may be added to the fluid. For instance, in about 15 minutes, the fluid may penetrate the casing and bore a hole in the rock stratum, which provides the suitable conditions for the next step of the fracturing operation.

Next, perforation may be performed at intervals using hydraulic sandblasting at intervals of 100 m. In the interval hydraulic sandblasting perforation, sand bridges may be established between the segments, which function to separate the previous well segments that have been compressed or pressurized. Considering that the pressure in every segment is identical in a horizontal well, it is necessary to add a certain quantity of crush-resistance fluid to the previous segment prior to the hydraulic fracturing of the annulus of each segment in order to increase the viscosity of the sand column in the previous segment, thereby avoiding any impact of the sand fracturing of the later segment on the previous segment.

Next, hydraulic sand fracturing may be performed in the annulus of the wellbore. During the fracturing, in accordance with the stress direction of the stratum, a high pressure, for instance, 50 MPa or higher, may be applied to the rock stratum through the fracturing fluid to cause the stratum to crack and generate a large number of fractures. Meanwhile, proppant may penetrate into the fractures, thereby establishing a passage for shale gas flow. The extension degree of the fracture may be controlled depending on the status of the stratum. The length of the fracture may be up to 100 m. The sand in the proppant may prevent the fractures from re-closing and reblocking the gas flow after the pressure of the fracturing vehicle is reduced. The stratum fractures may be connected in the form of nets or branches, which may increase shale gas output. The perforations at intervals via hydraulic sand blasting and hydraulic sand fracturing may be performed in the annulus until the fracturing operation of all the segments of the wellbore is completed.

After the fracturing operation of all the segments is completed, sand particles in the well may be moved to the surface through repetitive sand washing and well washing.

Next, recovering shale gas from the well may be carried out. During shale gas recovery, at well location 1 where the gas production conditions are met, displacement fluid may be sprayed to replace the fracturing fluid or gas injection may be used to lift the gas out of the fractures and thereby displace the shale gas out of the well for separation of shale gas and liquid.

After gas-liquid separation, the obtained liquid may be pumped into the collection tank 4 for treatment.

Next, at least part of the shale gas recovered from the wells may be supplied to an electrical generator 6 for electricity generation, and the generated electricity may be transferred to the equipment used for shale gas operation or at least part of the equipment used for shale gas operation. The equipment used in the shale gas operation may be further provided with an external power supply during the operation process.

It is understood that, in this embodiment, the liquid used for fracturing operation may be stored and transferred with any liquid container described in the first to sixth embodiments.

Referring to FIGS. 1A, 1B, and 2A-2E, in some embodiments, the shale gas operation method includes the following steps.

Drilling one or more wells in a plurality of well locations may be performed. Initially, and a substantially vertical well may be drilled. At the first vertical well section 90, the well may be drilled using a self-walking 30 DBS super single drilling machine as a first drilling machine 98. Then, the water-containing or complicated layer may be penetrated, the surface stratum casing may be lowered, and the well may be secured. After the vertical well section is drilled at the first well location 1, the self-walking 30 DBS super single drilling machine may be moved by 4 to 5 meters to a next well location 9 and the above substantially vertical well drilling operation may be performed at the next well location 9. Drilling of all of the vertical well sections 90 may be completed at all of the well locations 1,9.

Using a super single drilling machine as the first drilling machine provides beneficial effects, e.g., a small floor area, convenient transportation, quick installation and high automation level.

Next, drilling a substantially horizontal well section 91 may be performed. A 50 DBS drilling machine may be used as a second drilling machine 92 for step drilling. In some embodiments, after a casing of 30 m is drilled, directional drilling may be carried out with dynamic drilling tools having MWD measuring meters integrated to the drilling tool. The target zone may be located in the middle part of shale gas layer. After the landing point is achieved, drilling a substantially horizontal well section may be carried out.

The length of the horizontal well section 91 may be approximately 2 km. In some embodiments, the first drilling machine 98 used for drilling a vertical well section and the second drilling machine 92 used for drilling a horizontal well section 91 may be operated simultaneously at the well site. After drilling the horizontal well section is completed, the production stratum casing may be lowered and the well may be secured.

Next, fracturing operations may be performed at various well locations. The fracturing operations may be performed with hydraulic sand-blasting perforation and sand fracturing to the annulus. The fracturing equipment may include a coiled tubing drilling system needed for the fracturing operation, an injection head such as perforation tool 950, a fracturing vehicle 93 and a liquid container 4.

In some embodiments, the perforation via hydraulic sand blasting may be performed as follows. The fracturing vehicle 93 is connected with the hydraulic sand blasting perforation equipment 95. The tools necessary for the hydraulic sand blasting perforation, e.g. injection head or perforation tool 950, may be connected to the coiled tubing drilling system of the hydraulic sand blasting perforation equipment 95, and the hydraulic sand blasting perforation tools 950 are installed at a predetermined position in the well through the coiled tubing drilling system.

Next, the hydraulic sand blasting perforation may be performed at an interval of 150 m. Next, annular sand fracturing may be performed at a space interval of 150 m. The interval hydraulic sand blasting perforation and annular sand fracturing may be repeated until the fracturing operation of all the wells is completed.

In the interval fracturing operation, sand bridges may be established among the segments, which may separate the previous well segments that have been fractured. After the fracturing of all the segments is completed, all the sand particles may be flushed out of the well shaft with repetitive sand washing.

Next, recovering shale gas from a well may be performed. After cleaning the well, the gas in the well may be pushed out and replaced by spraying a displacement fluid or by injecting a gas via a gas lifting method. The shale gas may flow to the wellhead and converge in the gas pipe. Referring to FIGS. 1A-2D, through separator 2, liquid may be separated from the shale gas. The shale gas enters a gas collection station 3, and the liquid enters a tank 4. The liquid may flow from a number of well yards and converge in the tank 4, and may further be treated in a treatment station.

Next, at least part of the shale gas recovered from the wells may be supplied to an electrical generator 6 for electricity generation, and the generated electricity may be transferred to the equipment used for shale gas operation or at least part of the equipment used for shale gas operation.

The equipment used in the shale gas operation may need external power supply in the operation process. Such equipment includes a drilling machine, a fracturing vehicle, and other electricity-consuming equipment used in the shale gas operation.

When at least part of the gas wells meet the condition for gas production conditions, instead of the diesel generator 5, an electrical generator 6 that generates electricity from the self-produced shale gas may be used to provide electric power to the equipment such as an electric drilling machine and a fracturing vehicle. Accordingly, it can not only reduce the costs associated with well drilling and completing but also reduce pollutant emission.

It is understood that, in this embodiment, the liquid used for fracturing operation may be stored and transferred with any liquid container described in the first to sixth embodiments.

In this embodiment, the other features of the shale gas operation method may be substantially similar to those provided above for the first embodiment. The liquid container used for the fracturing operation may be stored and transferred with any of the liquid containers described in the first to sixth embodiments.

Figure 34:
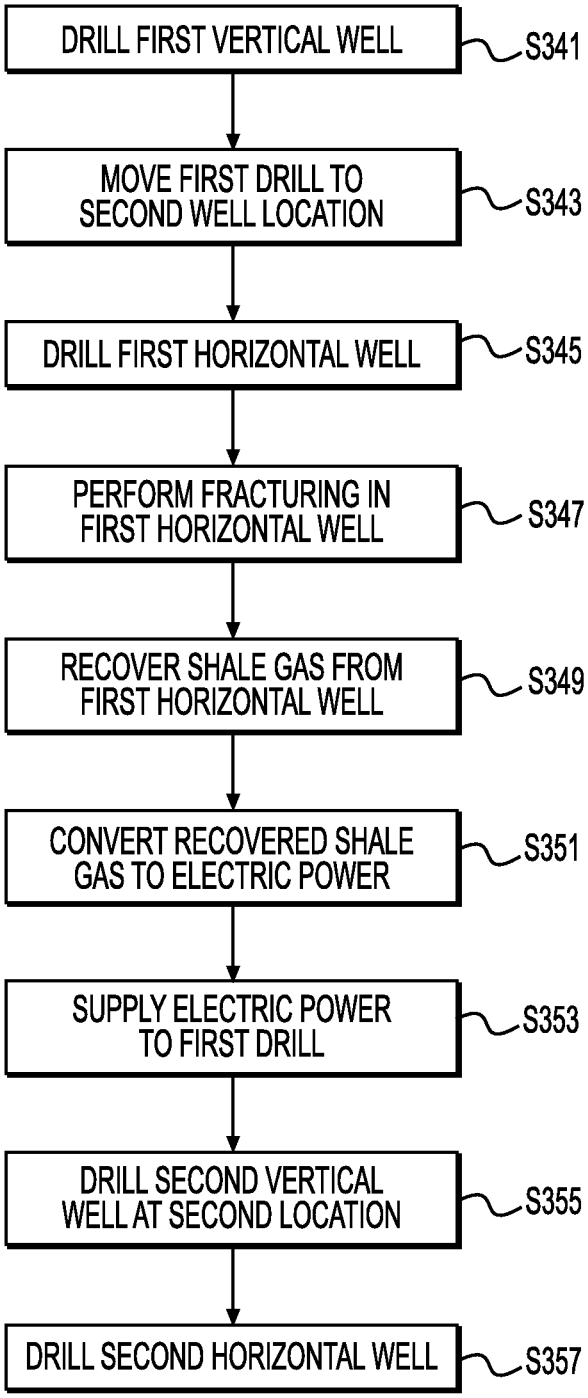
FIG. 34 is a flow diagram of an exemplary method.

Turning now to FIG. 34, a method for shale gas operation is outlined. In step S341, a first vertical well is drilled, and in step S343, the first drill is moved to a second well location. In step S345, a first horizontal well is drilled. In step S347, fracturing is performed in the first horizontal well, and in step S349, shale gas is recovered from the first horizontal well. In step S351, the recovered shale gas is converted to electric power. The electric power is supplied to the first drill in step S353 in order to drill a second vertical well at the second location in step S355. In step S357, the second horizontal well is drilled.

Although, for purposes of this disclosure, certain disclosed features are shown in some figures but not in others, it is contemplated that, to the extent possible, the various features disclosed herein may be implemented by each of the disclosed, exemplary embodiments. Accordingly, differing features disclosed herein are not to be interpreted as being mutually exclusive to different embodiments unless explicitly specified herein or such mutual exclusivity is readily understood, by one of ordinary skill in the art, to be inherent in view of the nature of the given features.

While the presently disclosed devices have been described with reference to the specific embodiments thereof, it should be understood by those skilled in the art that various changes may be made and equivalents may be substituted without departing from the scope of the disclosure. In addition, many modifications may be made to adapt a particular situation, material, composition of matter, process, process step, or steps to the objective, spirit, and scope of the present invention. Other embodiments of the invention will be apparent to those skilled in the art from consideration of the specification and practice of the invention disclosed herein. It is intended that the specification and examples be considered as exemplary only.

What is claimed is:

1. A method for performing a shale gas operation, comprising:

drilling a substantially vertical first well at a first location with a first drill and a first set of electrical equipment;

drilling a first substantially horizontal well section from the first well using a second drill;

performing a fracturing operation in the first well with a fracturing vehicle and the first set of electrical equipment;

recovering shale gas from the first well;

supplying at least part of the shale gas recovered from the first well to an electricity generator;

generating electricity using the electricity generator with the supplied shale gas;

moving the first drill to a second location;

supplying a portion of the generated electricity to a second set of electrical equipment used to drill a second well at the second location;

drilling the second well substantially vertically at the second location with the first drill and the second set of electrical equipment;

moving the second drill to the second well;

drilling a second substantially horizontal well section from the second well using the second drill and the second set of electrical equipment moving the fracturing vehicle to the second well;

supplying another portion of the generated electricity to a third set of electrical equipment; and powering the fracturing vehicle using the third set of electrical equipment to perform a fracturing operation in the second well.

2. The method of claim 1, wherein the fracturing vehicle, the first drill, and the second drill are compatible with each of the first set of electrical equipment, the second set of electrical equipment, and the third set of electrical equipment.

3. The method of claim 1, further comprising installing a casing in the first well, wherein the fracturing vehicle further comprises sand blasting equipment for perforation operations, and wherein the fracturing operation further comprises:

placing the sand blasting equipment at a first position in the first well;

perforating the casing with a liquid and the sand blasting equipment at the first position;

performing wellbore sand fracturing at the first position;

repeating the perforating at intervals of 110 meters to 150 meters from the first position; and repeating the wellbore sand fracturing at the intervals.

4. The method of claim 1, further comprising performing well cleaning to remove sand grains from the first well.

5. The method of claim 1, wherein the step of recovering shale gas further comprises:

performing an extraction operation to lead the shale gas out of the well and to recover liquid from at least the perforating;

separating the shale gas from the recovered liquid; and transferring the recovered liquid to a liquid container.

6. The method of claim 1, further comprising storing a liquid used in the fracturing operation in a liquid container, the liquid container comprising:

a first frame;

a second frame;

a foldable support structure comprising a first linkage and a second linkage forming a first supporting structure, a third linkage and a fourth linkage forming a second supporting structure, a first pivoting mechanism, and a second pivoting mechanism, wherein the first linkage and the second linkage are cross-connected and pivotally connected by the first pivoting mechanism, and wherein the third linkage and the fourth linkage are cross-connected and pivotally connected by the second pivoting mechanism;

a first sliding mechanism connecting a first end of the second linkage to the first frame;

a second sliding mechanism connecting a first end of the first linkage to the second frame;

a third sliding mechanism connecting a first end of the third linkage to the second frame; and a fourth sliding mechanism connecting a first end of the fourth linkage to the first frame, wherein a second end of the first linkage is connected to the first frame, wherein a second end of the second linkage is connected to the second frame, wherein a second end of the third linkage is connected to the first frame, and wherein a second end of the fourth linkage is connected to the second frame.

7. The method of claim 6, wherein the liquid container further comprises a locking mechanism in the first sliding mechanism, and wherein the method further comprises:

extending the first frame away from the second frame, thereby causing the first supporting structure and the second supporting structure to each form a respective "X" configuration, and thereby causing the first sliding mechanism to align with a locking area on the second frame; and locking the locking mechanism to secure the liquid container in an expanded position.

8. The method of claim 7, further comprising:

treating the liquid stored in the liquid container; and unlocking the locking mechanism to fold the liquid container, thereby causing the first sliding mechanism and the second sliding mechanism to slide on the second frame, and thereby causing the first supporting structure to collapse and the second supporting structure to collapse.

9. The method of claim 7, wherein the liquid container further comprises:

the third sliding mechanism positioned between the first supporting structure and the first frame;

the fourth sliding mechanism positioned between the second supporting structure and the first frame, a second locking mechanism on the second sliding mechanism;

a third locking mechanism on the third sliding mechanism; and a fourth locking mechanism on the fourth sliding mechanism, and wherein the method further comprises locking the second locking mechanism, the third locking mechanism, and the fourth locking mechanism to secure the liquid container in an expanded position.

10. The method of claim 7, wherein the locking mechanism comprises a position locking bar and a pulling link connected with the position locking bar, and wherein the locking step comprises articulating the pulling link to rotate the position locking bar.

11. The method of claim 6, wherein the liquid container further comprises:

a net connected at least to the first supporting structure and to the second supporting structure by elastic stays; and a soft capsule connected to the first frame, and wherein the method further comprises supporting the soft capsule within a perimeter of the liquid container using the net.

12. The method of claim 6, wherein the liquid container further comprises:

a receiving container;

a base support at a bottom of the second frame; and a capsule at least partially disposed within the receiving container.

13. The method of claim 12, wherein the receiving container is a rigid container.

14. The method of claim 12, wherein the capsule is flexible.

15. The method of claim 6, further comprising a ring structure configured to secure a top portion of a soft capsule to the first frame.

16. The method of claim 6, wherein the first sliding mechanism further comprises a driving unit, and wherein the method further comprises electrically controlling the driving unit to push or pull the first sliding mechanism.

17. The method of claim 6, wherein the first sliding mechanism comprises one of a sliding sleeve and a sliding track.

18. The method of claim 1, wherein the first set of electrical equipment, the second set of electrical equipment, and the third set of electrical equipment are mobile structures.

19. The method of claim 1, wherein the second set of electrical equipment and the third set of electrical equipment are part of a centralized power installation.

20. A method for performing a shale gas operation, comprising:

drilling a first well at a first location with a first drill and a first set of electrical equipment;

performing a fracturing operation in the first well with a fracturing vehicle and the first set of electrical equipment;

recovering shale gas from the first well;

supplying at least part of the shale gas recovered from the first well to an electricity generator;

generating electricity using the electricity generator with the supplied shale gas;

supplying a portion of the generated electricity to a second set of electrical equipment used to drill a second well;

moving the fracturing vehicle to the second well;

supplying another portion of the generated electricity to a third set of electrical equipment;

powering the fracturing vehicle using the third set of electrical equipment to perform a fracturing operation in the second well; and storing a liquid used in the fracturing operations in a liquid container, the liquid container comprising:

a first frame;

a second frame;

a foldable support structure comprising a first linkage and a second linkage forming a first supporting structure, a third linkage and a fourth linkage forming a second supporting structure, a first pivoting mechanism, and a second pivoting mechanism, wherein the first linkage and the second linkage are cross-connected and pivotally connected by the first pivoting mechanism, and wherein the third linkage and the fourth linkage are cross-connected and pivotally connected by the second pivoting mechanism;

a first sliding mechanism connecting a first end of the second linkage to the first frame;

a second sliding mechanism connecting a first end of the first linkage to the second frame;

a third sliding mechanism connecting a first end of the third linkage to the second frame; and a fourth sliding mechanism connecting a first end of the fourth linkage to the first frame, wherein a second end of the first linkage is connected to the first frame, wherein a second end of the second linkage is connected to the second frame, wherein a second end of the third linkage is connected to the first frame, and wherein a second end of the fourth linkage is connected to the second frame.

* * * * *